US009695005B2

(12) United States Patent
Hirano et al.

(10) Patent No.: US 9,695,005 B2
(45) Date of Patent: Jul. 4, 2017

(54) PAPER-SHEET COUNTING MACHINE

(71) Applicant: GLORY LTD., Himeji-Shi, Hyogo-Ken (JP)

(72) Inventors: Manabu Hirano, Saitama (JP); Fumiaki Koga, Tokyo-To (JP); Tomoyasu Sato, Tokyo-To (JP)

(73) Assignee: GLORY LTD., Himeji-Shi, Hyogo-Ken (JP)

( * ) Notice: Subject to any disclaimer, the term of this patent is extended or adjusted under 35 U.S.C. 154(b) by 0 days.

(21) Appl. No.: 14/568,604

(22) Filed: Dec. 12, 2014

(65) Prior Publication Data

US 2015/0093229 A1 Apr. 2, 2015

Related U.S. Application Data

(63) Continuation of application No. 13/202,447, filed as application No. PCT/JP2009/052901 on Feb. 19, 2009, now abandoned.

(51) Int. Cl.
*B65H 33/00* (2006.01)
*B65H 43/06* (2006.01)
(Continued)

(52) U.S. Cl.
CPC ..... *B65H 33/00* (2013.01); *B65H 29/001* (2013.01); *B65H 29/40* (2013.01); *B65H 29/62* (2013.01);
(Continued)

(58) Field of Classification Search
CPC ..... G07D 11/0003; G07D 11/0006; G07D 11/0009; G07D 11/0021; G07D 11/0045;
(Continued)

(56) References Cited

U.S. PATENT DOCUMENTS 3,724,717 A * 4/1973 Goto ..... 221/155
4,239,204 A * 12/1980 Miyagawa et al. ..... 271/171
(Continued)

FOREIGN PATENT DOCUMENTS

EP 1 035 521 A1 9/2000
GB 2 020 459 A 11/1979
JP 2003-248855 A 9/2003

OTHER PUBLICATIONS

European Search Report (Application No. 16186744.5) (6 pages—dated Jan. 24, 2017).

*Primary Examiner* — Ernesto Suarez
(74) *Attorney, Agent, or Firm* — Renner, Kenner, Greive, Bobak, Taylor & Weber

(57) ABSTRACT

A paper-sheet counting machine (10) includes: a recognition and counting unit (24) configured to count paper sheets; a stacking unit (26) configured to stack therein the paper sheets that have been counted by the recognition and counting unit (24), an opening being provided in a front face of the stacking unit (26); a rotary guide unit (28) provided to the stacking unit (26) and configured to allow the paper sheets that have been counted by the recognition and counting unit (24) to be stacked in the stacking unit (26); a shutter (40) configured to close the opening provided in the front face of the stacking unit (26); a shutter drive unit (50) configured to drive the shutter (40) to open and close the opening provided in the front face of the stacking unit (26); and a control unit (70) configured to control the shutter drive unit (50).

6 Claims, 8 Drawing Sheets

(51) Int. Cl.

| | |
|---|---|
| ***B65H 29/00*** | (2006.01) |
| ***B65H 29/40*** | (2006.01) |
| ***B65H 29/62*** | (2006.01) |
| ***B65H 43/04*** | (2006.01) |
| ***G07D 11/00*** | (2006.01) |

(52) U.S. Cl.
CPC ..... *B65H 43/04* (2013.01); *B65H 43/06* (2013.01); *G07D 11/0081* (2013.01); *B65H 2301/4212* (2013.01); *B65H 2301/4214* (2013.01); *B65H 2402/45* (2013.01); *B65H 2403/512* (2013.01); *B65H 2403/732* (2013.01); *B65H 2404/632* (2013.01); *B65H 2407/10* (2013.01); *B65H 2407/20* (2013.01); *B65H 2511/20* (2013.01); *B65H 2511/30* (2013.01); *B65H 2511/51* (2013.01); *B65H 2601/271* (2013.01); *B65H 2701/1912* (2013.01)

(58) Field of Classification Search
CPC ..... G07D 11/006; G07D 11/0051; G07D 11/0054; G07D 11/0084; B65H 7/04; B65H 7/14; B65H 7/20; B65H 29/62; B65H 31/24; B65H 31/32; B65H 43/00; B65H 43/04; B65H 43/06; B65H 43/08; B65H 43/02; B65H 33/00; B65H 33/06; B65H 33/14; B65H 2301/426; B65H 2404/441; B65H 2404/443; B65H 2404/45; B65H 2407/32; B65H 2407/33; B65H 2511/30; B65H 2511/521; B65H 2601/321; B65H 2701/1912
See application file for complete search history.

(56) References Cited

U.S. PATENT DOCUMENTS

| | | | | |
|---|---|---|---|---|
| 4,275,874 | A * | 6/1981 | DiBlasio | 271/4.1 |
| 4,277,119 | A * | 7/1981 | Uchida | 312/138.1 |
| 4,566,109 | A * | 1/1986 | Sanuga | G07D 11/0003 271/4.1 |
| 4,571,489 | A * | 2/1986 | Watanabe | 235/379 |
| 4,677,682 | A | 6/1987 | Miyagawa et al. | |
| 4,744,468 | A * | 5/1988 | Goi et al. | 209/534 |
| 5,020,787 | A * | 6/1991 | Arikawa | 271/3.19 |
| 6,276,678 | B1 * | 8/2001 | Nottelmann et al. | 271/3.01 |
| 6,328,166 | B1 * | 12/2001 | Sakai | 209/534 |
| 6,357,598 | B1 * | 3/2002 | Kimura et al. | 209/534 |
| 6,507,769 | B2 * | 1/2003 | Urata et al. | 700/223 |
| 6,540,090 | B1 * | 4/2003 | Sakai et al. | 209/534 |
| 6,782,987 | B1 * | 8/2004 | Abe et al. | 194/207 |
| 2012/0002218 | A1 * | 1/2012 | Matsuura et al. | 358/1.6 |
| 2012/0006646 | A1 * | 1/2012 | Morino et al. | 194/206 |
| 2012/0285788 | A1 * | 11/2012 | Akamatsu et al. | 194/215 |

* cited by examiner

PAPER-SHEET COUNTING MACHINE

CROSS-REFERENCE TO RELATED APPLICATION

This application is a continuation of U.S. patent application Ser. No. 13/202,447 filed on Aug. 19, 2011, which was based upon and claimed the benefit of priority from the prior PCT/JP2009/052901 filed on Feb. 19, 2009, the entire contents of which are incorporated herein by reference.

FIELD OF THE INVENTION

The present invention relates to a paper-sheet counting machine adapted for counting paper sheets, such as banknotes, checks and the like.

BACKGROUND ART

In the past, various types of machines have been known as the paper-sheet counting machine adapted for counting the paper sheets, such as the banknotes, checks and the like. For instance, a banknote counting machine disclosed in JP2600100Y2 is provided for setting a plurality of banknotes in a stacked condition on a placing unit (e.g., a hopper), then feeding and inserting each banknote located at the lowest position of the banknotes into a space between a pair of gate units, one by one, by using a feeding unit, such as a feed roller or the like, provided at a bottom part of the placing unit, thereby separating such banknotes, one by one, and feeding each separated banknote downward, via a passage, and further feeding it into a space between two vanes of a stacking wheel located in the middle of the passage. Thereafter, each banknote received between the two vanes is thrown off therefrom, downward onto a stacking unit, while being turned round with rotation of the stacking wheel, and then arranged in the stacking unit. Further, in the banknote counting machine disclosed in JP2600100Y2, a sensor is provided for counting the number of the banknotes passing through this sensor, before such banknotes reach the stacking wheel.

Further, in JP3537697B and JP3741893B, a banknote processing machine provided for recognizing each banknote and then sorting the recognized banknote, based on each recognition result thereof, is disclosed. In such a banknote processing machine, a plurality of stacking units (or stackers) are provided for respectively receiving the banknotes that have been respectively sorted for each corresponding denomination of money and then fed to the stacking units. In this case, a shutter is provided to each stacker. This shutter serves to selectively close an opening of each stacking unit, in order to prevent access of an operator to the stacking unit.

DISCLOSURE OF THE INVENTION

However, in the conventional banknote counting machine as disclosed in the above JP2600100Y2, each banknote is stacked, with the rotation of the stacking wheel, while falling down forward from the back. Therefore, dust accumulated on the transport path and/or dust attached to each banknote tends to be blown out toward the operator. In addition, in this banknote counting machine, the sound generated in the interior of the machine during its operation tends to leak to the outside, thus making a considerable noise.

Further, in the above JP3537697B and JP3741893B, the shutter is provided to each stacking unit in the banknote processing machine. However, in this banknote processing machine, the opening is provided at an upper part of each stacking unit, and the shutter is designed for opening and closing such an opening provided at the upper part of each stacking unit. Therefore, this shutter is not directly intended for a dustproof application. More specifically, when in an opening position, the shutter provided to each stacking unit serves to allow the banknotes stacked in this stacking unit to be respectively taken out therefrom. Meanwhile, when in a closing position, this shutter serves to prevent any banknote from being taken out from the corresponding stacking unit. Namely, this shutter is intended only for providing the so-called locking function.

The present invention was made in view of the above problems. Therefore, it is an object of this invention to provide the paper-sheet counting machine that can prevent the dust accumulated in a casing of the machine and/or dust attached to each paper-sheet from being blown out toward the operator, as well as can successfully prevent the sound generated in the interior of the machine from leaking to the outside during the operation of the machine.

A paper-sheet counting machine of the present invention includes: a counting unit configured to count paper sheets; a stacking unit configured to stack therein the paper sheets that have been counted by the counting unit, an opening being provided in a front face of the stacking unit; a rotary guide unit provided to the stacking unit and configured to allow the paper sheets that have been counted by the counting unit to be stacked in the stacking unit; a shutter configured to close the opening provided in the front face of the stacking unit; a shutter drive unit configured to drive the shutter to open and close the opening provided in the front face of the stacking unit; and a control unit configured to control the shutter drive unit.

According to the aforementioned paper-sheet counting machine, the opening and closing operation for the opening provided in the front face of the stacking unit can be performed by the shutter driven by the shutter drive unit controlled by the control unit. Therefore, the opening provided in the front face of the stacking unit can be selectively closed by the shutter. Thus, when this shutter closes the opening, the blowing out of the dust accumulated in the casing of the paper-sheet counting machine and/or dust attached to each paper sheet, toward the operator, can be successfully prevented. Further, when the shutter closes the opening in the front face of the stacking unit, the unwanted leakage of the sound generated in the interior of the paper-sheet counting machine to the outside can be effectively prevented during the operation of the machine.

In the paper-sheet counting machine of the present invention, it is preferred that the rotary guide unit includes a stacking wheel configured to be rotated about a shaft extending in a substantially horizontal direction, the stacking wheel having a plurality of vanes respectively extending from the outer circumferential face of the stacking wheel, outward in a direction reverse to the rotation direction of the rotary guide unit, and the stacking wheel is configured to receive each paper sheet counted by the counting unit, between the vanes thereof, and then feed the paper sheet received between the vanes into the stacking unit.

In the paper-sheet counting machine of the present invention, it is preferred that the control unit controls the shutter drive unit to drive the shutter to close the opening provided in the front face of the stacking unit, before the counting process for the paper sheets is started by the counting unit.

Alternatively, the control unit may control the shutter drive unit to drive the shutter to start closing the opening provided in the front face of the stacking unit, at the same time as starting of the counting process for the paper sheets by the counting unit, thereby allowing the paper sheets to be counted, while the opening is closed.

In the aforementioned paper-sheet counting machine, it is further preferred that the paper-sheet counting machine further includes a placing unit configured to place thereon the paper sheets to be respectively counted by the counting unit, for allowing such paper sheets, respectively placed on the placing unit, to be fed, one by one, to the counting unit, and a first paper-sheet detection unit configured to detect whether or not the paper sheets are placed on the placing unit, and when the first paper-sheet detection unit detects that all of the paper sheets respectively placed on the placing unit are fed to the counting unit and thus there is no paper sheet remaining on the placing unit, the control unit controls the shutter drive unit to retreat the shutter from the opening provided in the front face of the stacking unit to open the opening.

In this case, it is further preferred that interval of time between the time the first paper-sheet detection unit detects that there is no paper sheet remaining on the placing unit and the time the control unit controls the shutter drive unit to retreat the shutter from the opening, is capable of being altered by settings.

It is further preferred that the counting unit is configured to recognize the paper sheets, and the paper-sheet counting machine further comprises a reject unit configured to receive the paper sheets respectively recognized as reject paper sheets by the counting unit and fed thereto from the counting unit, and a second paper-sheet detection unit configured to detect whether or not the paper sheets are stacked in the reject unit, and when the first paper-sheet detection unit detects that there is no paper sheet remaining on the placing unit and when the second paper-sheet detection unit detects that there is a paper sheet or sheets in the reject unit, the control unit serves to drive the shutter to keep closing the opening provided in the front face of the stacking unit.

It is further preferred that the control unit serves to selectively perform a batch process mode, in which the counting unit counts paper sheets by the batch number, the batch number being instructed to the control unit, and when the first paper-sheet detection unit detects that there is no paper sheet remaining on the placing unit and when the number of the paper sheets fed to the stacking unit does not reach the batch number, during the process for the paper sheets in the batch process mode performed by the control unit, the control unit serves to drive the shutter to keep closing the opening provided in the front face of the stacking unit.

In the paper-sheet counting machine of the present invention, it is preferred that the control unit serves to selectively perform a batch process mode, in which the counting unit counts paper sheets by the batch number, the batch number being instructed to the control unit, and when the batch number inputted to the control unit is smaller than a preset number, during the process for the paper sheets in the batch process mode performed by the control unit, the control unit serves to retreat the shutter from the opening provided in the front face of the stacking unit to keep the opening opened.

In the paper-sheet counting machine of the present invention, it is preferred that the paper-sheet counting machine further comprises a placing unit configured to place thereon the paper sheets to be respectively counted by the counting unit, for allowing such paper sheets, respectively placed on the placing unit, to be fed, one by one, to the counting unit, and a third paper-sheet detection unit provided between the placing unit and the stacking unit and configured to detect each paper sheet when the paper sheet fed to the stacking unit from the placing unit passes through the third paper-sheet detection unit, and the control unit serves to selectively perform a batch process mode, in which the counting unit counts paper sheets by the batch number, the batch number being instructed to the control unit, and when the batch number inputted to the control unit is equal to or greater than the preset number, during the process for the paper sheets in the batch process mode performed by the control unit, the control unit controls the shutter drive unit to drive the shutter to close the opening provided in the front face of the stacking unit, before the counting process for the paper sheets is started by the counting unit, and when the third paper-sheet detection unit detects the last paper sheet of the batch number, the control unit controls the shutter drive unit to retreat the shutter from the opening provided in the front face of the stacking unit to open the opening.

In this case, it is further preferred that interval of time between the time the third paper-sheet detection unit detects the last paper sheet of the batch number and the time the control unit controls the shutter drive unit to retreat the shutter from the opening, is capable of being altered by settings.

In the paper-sheet counting machine of the present invention, it is preferred that the paper-sheet counting machine further comprises a placing unit configured to place thereon the paper sheets to be respectively counted by the counting unit, for allowing such paper sheets, respectively placed on the placing unit, to be fed, one by one, to the counting unit, and a third paper-sheet detection unit provided between the placing unit and the stacking unit and configured to detect each paper sheet when the paper sheet fed to the stacking unit from the placing unit passes through the third paper-sheet detection unit, and the control unit controls the shutter drive unit to drive the shutter to close the opening provided in the front face of the stacking unit, before the counting process for the paper sheets is started by the counting unit, and when the third paper-sheet detection unit detects a certain paper sheet, with which the stacking unit will be full up upon receiving thereof, the control unit controls the shutter drive unit to retreat the shutter from the opening provided in the front face of the stacking unit to open the opening.

In this case, it is further preferred that interval of time between the time the third paper-sheet detection unit detects the paper sheet, with which the stacking unit will be full up upon receiving thereof, and the time the control unit controls the shutter drive unit to retreat the shutter from the opening, is capable of being altered by settings.

It is further preferred that the third paper-sheet detection unit is provided in such a position that interval of time between the time the paper sheet is detected by the third paper-sheet detection unit and the time this paper sheet is fed to the stacking unit is substantially matched with the time required for the shutter to be moved from the position for closing the opening provided in the front face of the stacking unit to the position for opening the same opening.

In the paper-sheet counting machine of the present invention, it is preferred that the control unit performs selectively either one of a with-shutter-operation mode, in which the control unit controls the shutter drive unit to drive the shutter to open and close the opening provided in the front face of the stacking unit, and a without-shutter-operation mode, in which the shutter drive unit is not controlled by the control unit, and thus the opening and closing operation for the opening provided in the front face of the stacking unit is not performed by the shutter.

In the paper-sheet counting machine of the present invention, it is preferred that the shutter is configured to be retreated from the opening provided in the front face of the stacking unit, by hand, even during the counting process for the paper sheets by the counting unit.

In the paper-sheet counting machine of the present invention, it is preferred that the shutter is composed of a transparent material.

In the paper-sheet counting machine of the present invention, it is preferred that the shutter is capable of being reciprocated, about a shaft, between a closing position for closing the opening provided in the front face of the stacking unit and an opening position retreated from the opening to open the opening, the opening position being located below the rotary guide unit.

In the paper-sheet counting machine of the present invention, it is preferred that an elastic member is provided to the shutter, and a cam configured to be engaged with the shutter is provided to the shutter drive unit, and the shutter is biased toward the closing position for closing the opening provided in the front face of the stacking unit, by contraction force of the elastic member, and is adapted to be retreated from the opening, toward the opening position for opening the opening, by the cam provided to the shutter drive unit.

Alternatively, a gear and a torque limiter may be respectively provided between the shutter and the shutter drive unit, and the driving force applied from the shutter drive unit is transmitted to the shutter, via the gear and torque limiter, and when force greater than a preset torque is applied to the torque limiter, the torque limiter may serve to block the driving force transmitted from the shutter drive unit to the shutter.

BRIEF DESCRIPTION OF THE DRAWINGS

FIG. 5 is a block diagram for illustrating a control system of the paper-sheet counting machine shown in FIG. 1 and the like.

FIG. 6 is a flow chart showing a series of operations, respectively performed by the paper-sheet counting machine shown in FIG. 1 and the like.

FIG. 7 is another flow chart further showing the series of operations, respectively performed by the paper-sheet counting machine shown in FIG. 1 and the like.

FIG. 8 is still another flow chart further showing the series of operations, respectively performed by the paper-sheet counting machine shown in FIG. 1 and the like.

DETAILED DESCRIPTION OF THE INVENTION

Figure 1:
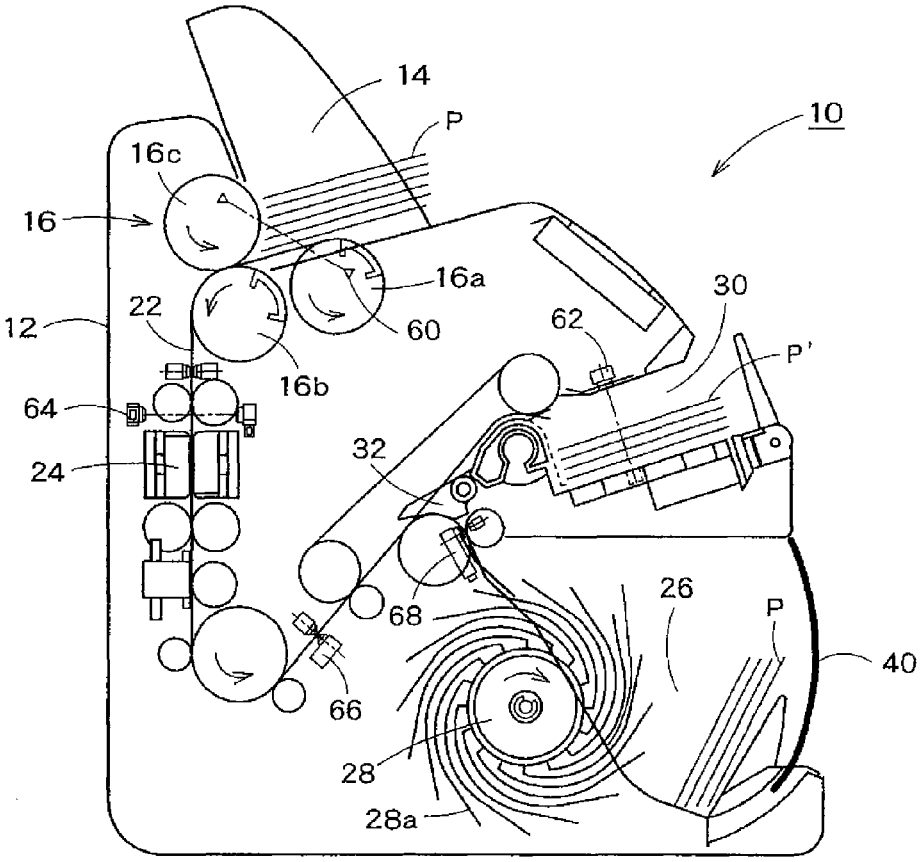
FIG. 1 is a drawing for schematically illustrating the internal construction of a paper-sheet counting machine related to one embodiment of the present invention, when a shutter closes an opening provided in the front face of a stacking unit.
Figure 2:
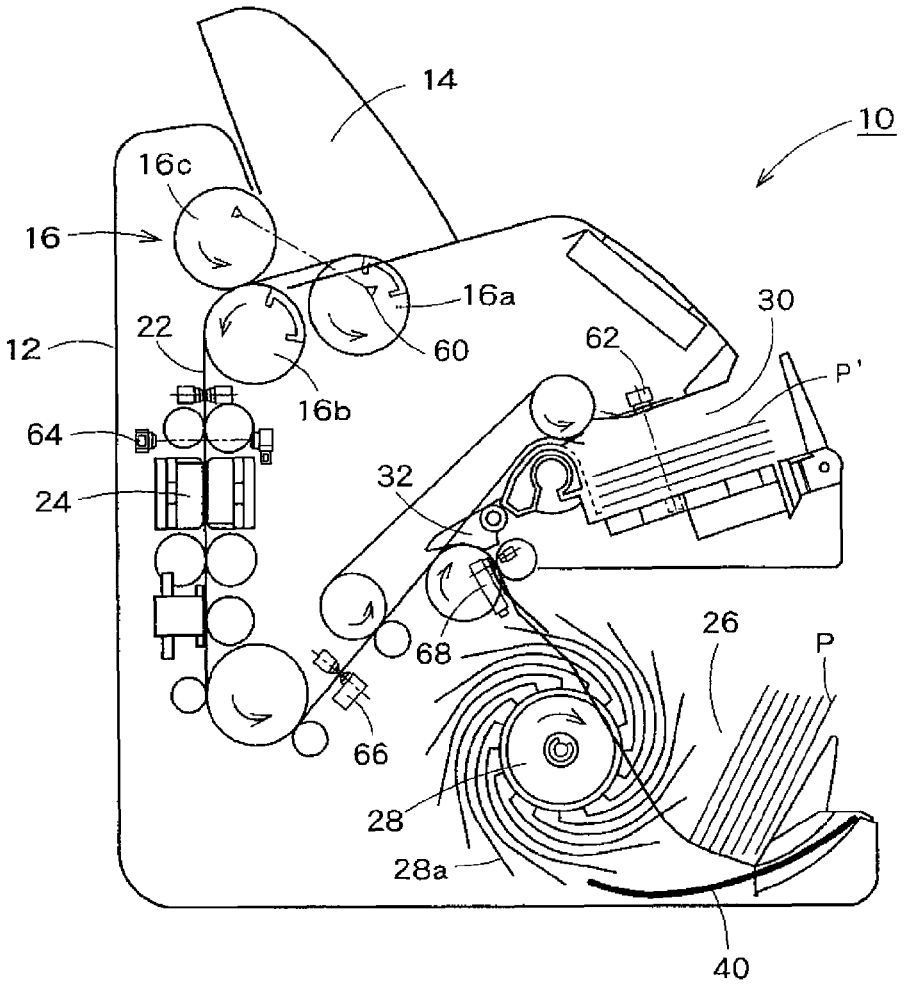
FIG. 2 is a drawing for schematically illustrating the internal construction of the paper-sheet counting machine shown in FIG. 1, when the shutter is retreated from the opening provided in the front face of the stacking unit to open the opening.
Figure 3:
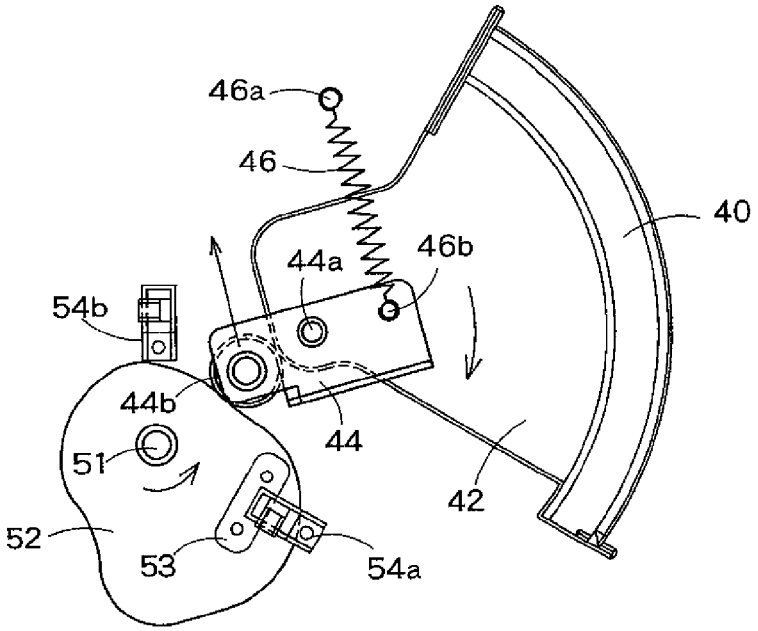
FIG. 3 is a drawing for illustrating details of the construction of the shutter, a shutter support unit for supporting the shutter, a shutter drive unit and the like, respectively provided in the paper-sheet counting machine shown in FIG. 1 and the like, when the shutter closes the opening provided in the front face of the stacking unit.
Figure 4:
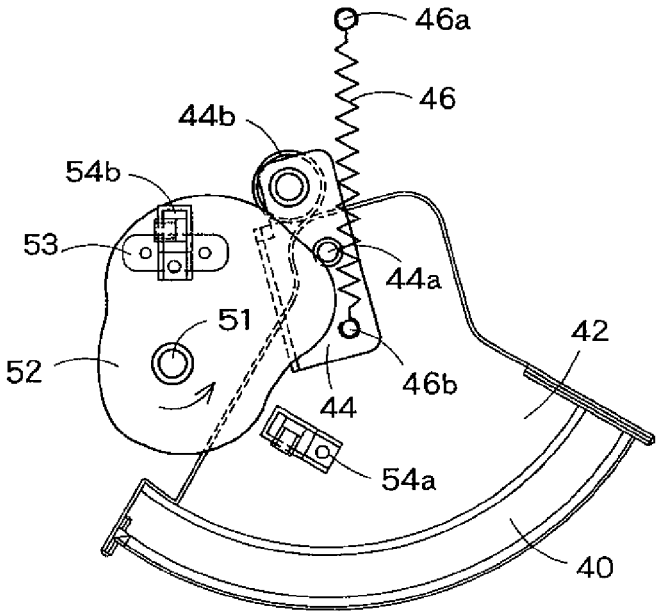
FIG. 4 is another drawing for illustrating the details of the construction of the shutter, shutter support unit for supporting the shutter, shutter drive unit and the like, respectively provided in the paper-sheet counting machine shown in FIG. 1 and the like, when the shutter is retreated from the opening provided in the front face of the stacking unit to open the opening.
Figure 5:
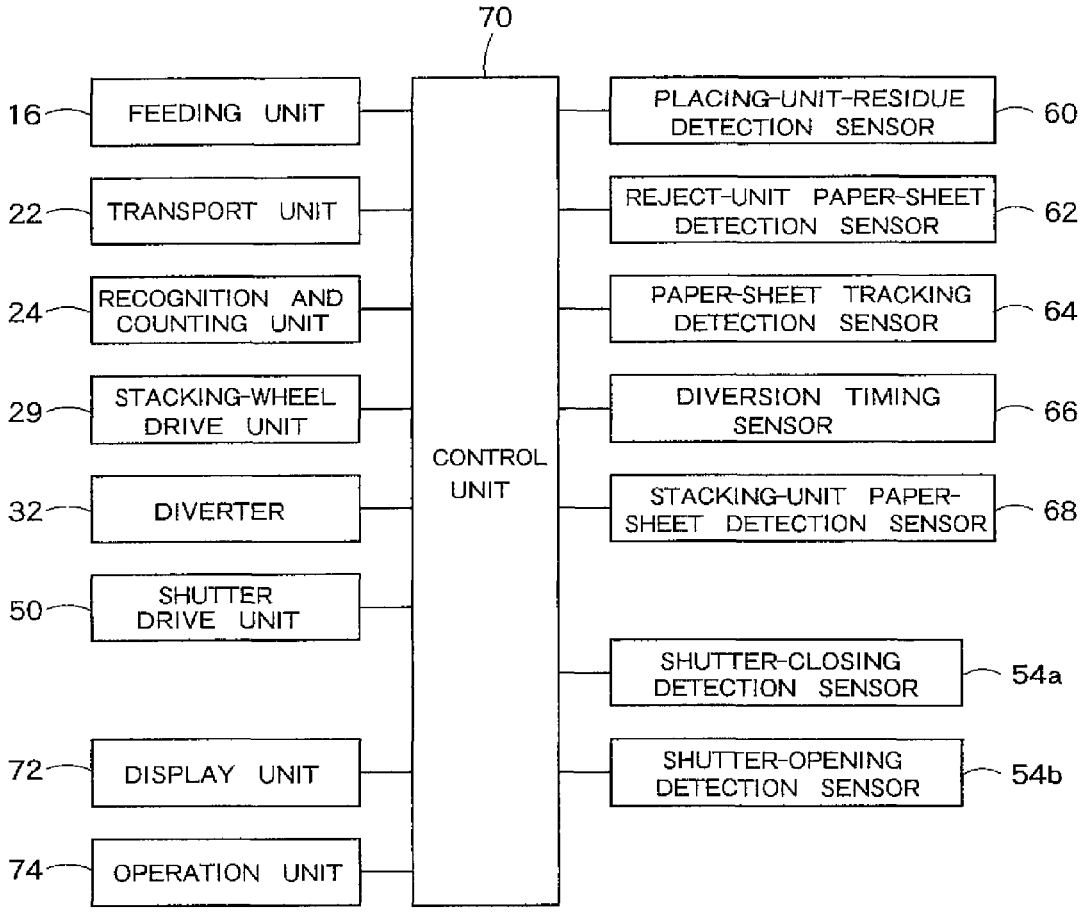
Figure 6:
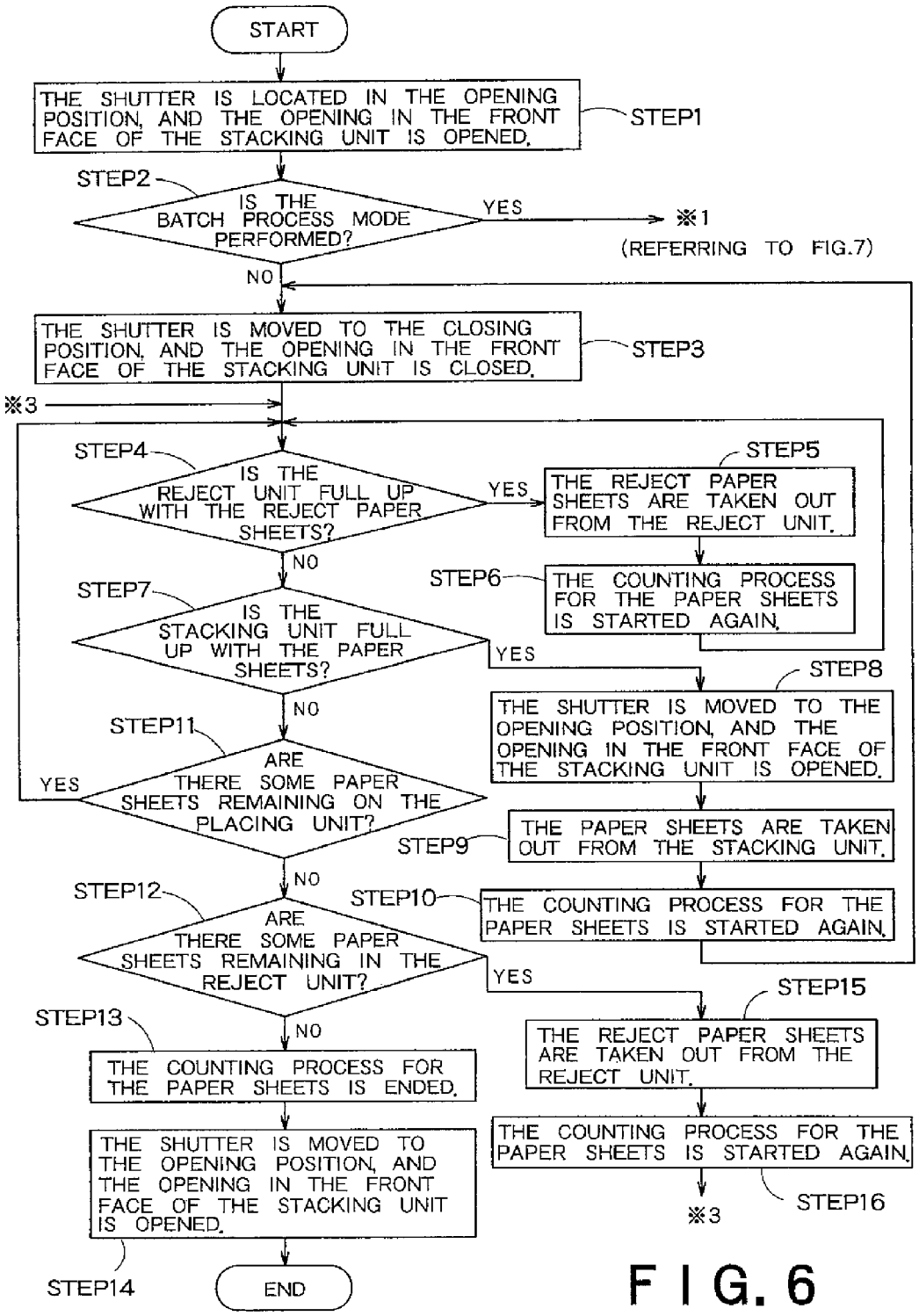
Figure 7:
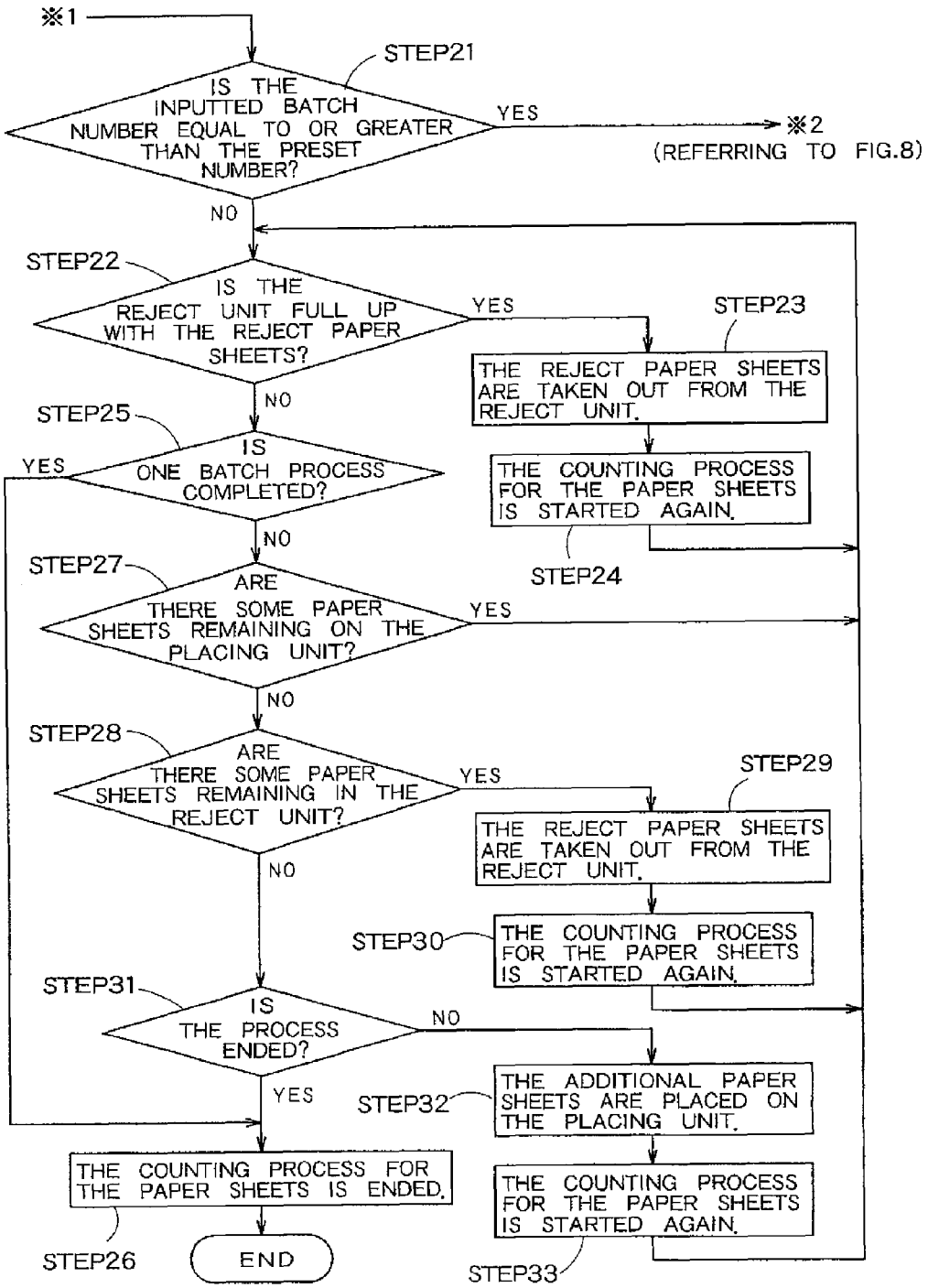
Figure 8:
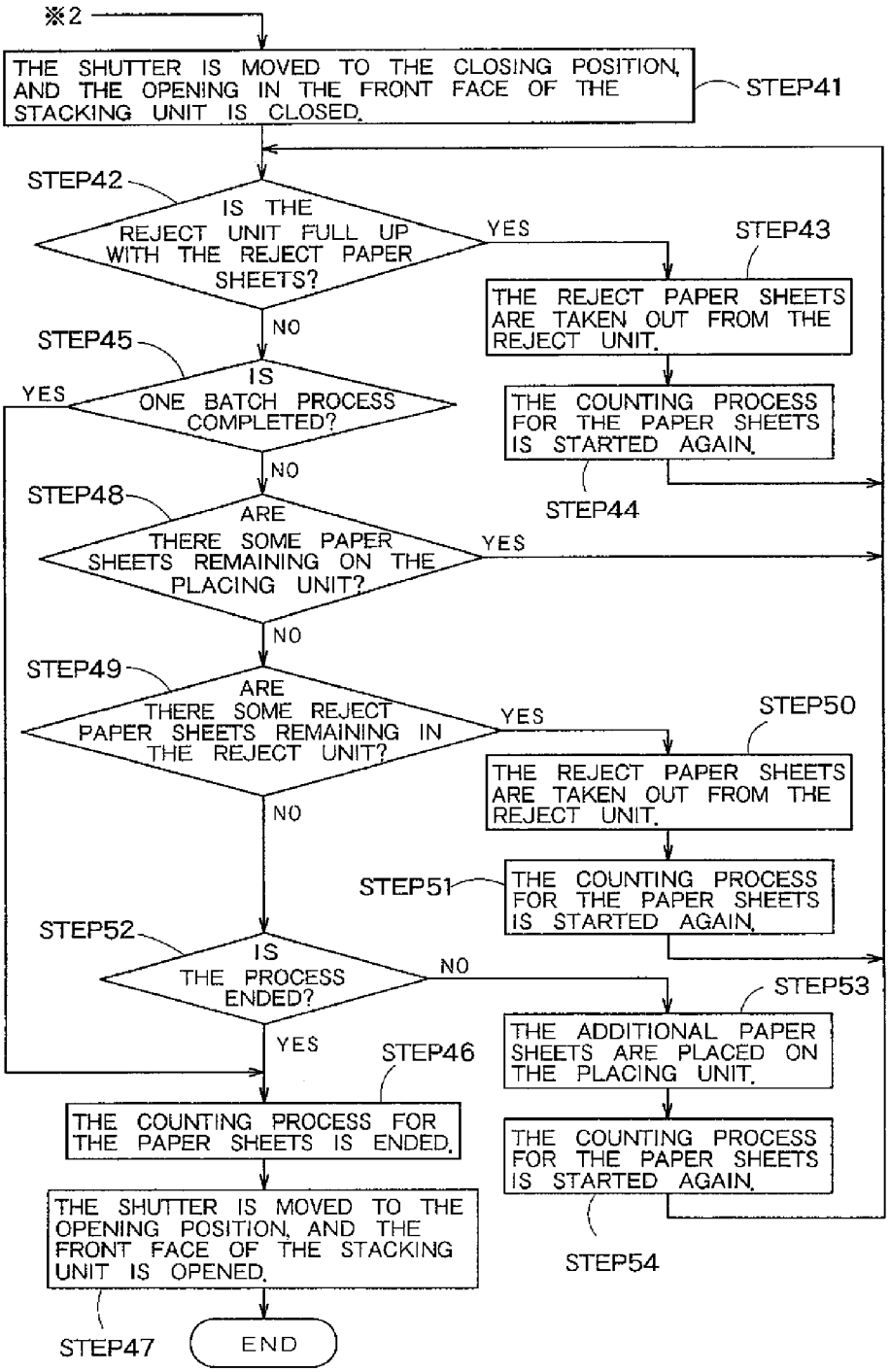

Hereinafter, one embodiment of the present invention will be described, with reference to the drawings. Of these drawings, FIGS. 1 through 8 are respectively provided for illustrating the paper-sheet counting machine related to the embodiment. More specifically, FIGS. 1 and 2 are respectively provided for schematically illustrating the internal construction of the paper-sheet counting machine related to the embodiment. FIGS. 3 and 4 are respectively provided for illustrating the details of the construction of the shutter, shutter support unit for supporting the shutter, shutter drive unit and the like, respectively provided in the paper-sheet counting machine shown in FIG. 1 and the like. The block diagram of FIG. 5 is provided for illustrating one exemplary control system of the paper-sheet counting machine shown in FIG. 1 and the like. Each flow chart of FIGS. 6 through 8 illustrates the series of operations, respectively performed by the paper-sheet counting machine shown in FIG. 1 and the like. It is noted that the paper-sheet counting machine related to this embodiment is intended for counting the number of the paper sheets, such as the banknotes, checks and the like.

As illustrated in FIGS. 1 and 2, a paper-sheet counting machine 10 includes a casing 12 and a placing unit 14 adapted for placing thereon a plurality of paper sheets P to be respectively counted, in a stacked condition. Further, this paper-sheet counting machine 10 includes a feeding unit 16 adapted for feeding each paper sheet P located at the lowermost layer of the paper sheets P placed on the placing unit 14 in the stacked condition, one by one, into the casing 12, and a transport unit 22 adapted for transporting the paper sheets P, respectively fed into the casing 12 by the feeding unit 16, one by one. In FIGS. 1 and 2, the right side face of the casing 12 is depicted as the front face thereof, while the left side face of the casing 12 shows the back face thereof. In addition, a recognition and counting unit 24 adapted for recognizing and counting the paper sheets P respectively fed into the casing 12 from the placing unit 14 is provided to the transport unit 22. For instance, the recognition and counting unit 24 is composed of a line sensor.

The feeding unit 16 includes a kicker roller **16*a* provided to be in contact with the surface of one paper sheet P located at the lowermost layer of the paper sheets P placed on the placing unit 14 in the stacked condition, and a feed roller 16*b* located on the downstream side, in the feeding direction of the paper sheets P, relative to the kicker roller 16*a* and adapted for feeding the paper sheets P, respectively kicked out by the kicker roller 16*a*, into the casing 12. Further, a gate roller (or reverse rotation roller) 16***c* is provided to be opposed to the feed roller 16*b*, with a gate part provided between the feed roller 16*b* and the gate roller 16*c*. Thus, each paper sheet P kicked out by the kicker roller 16*a* is passed through the gate part and then fed out, one by one, toward the transport unit 22 in the casing 12.

The transport unit 22 is bifurcated into two transport paths at a point located on the downstream side relative to the recognition and counting unit 24, and one of the two bifurcated transport paths is connected with a stacking unit 26, while the other transport path is connected with a reject unit 30. To the stacking unit 26, each paper sheet P that has been recognized as a normal paper sheet by the recognition and counting unit 24 is fed. An opening is provided in the front face of the stacking unit 26 (i.e., the face of the stacking unit 26 depicted on the right side in FIGS. 1 and 2), such that the operator can take out the paper sheets P respectively stacked in the stacking unit 26, via this opening.

Meanwhile, each paper sheet that is not recognized as the normal paper sheet by the recognition and counting unit 24 and each paper sheet that cannot be recognized by the recognition and counting unit 24 are respectively fed to a reject unit 30, as reject paper sheets P', by the transport unit 22. Similarly, one opening is provided in the front face of the reject unit 30, such that the operator can take out the reject paper sheets P' respectively stacked in the reject unit 30, via this opening.

As shown in FIGS. 1 and 2, a diverter 32 is provided at the same point where the transport unit 22 is bifurcated into the two transport paths. Due to this diverter 32, each paper sheet that has been fed from the upstream side of the diverter 32 can be selectively fed to either one of the two bifurcated transport paths.

A stacking wheel 28 is provided on the back face side (i.e., in a position located on the left side shown in FIGS. 1 and 2) of the stacking unit 26 in the casing 12. This stacking wheel 28 is configured to be rotated in a clockwise direction in FIG. 1 and the like (i.e., the direction indicated by an arrow depicted in FIGS. 1 and 2) about a shaft extending in a substantially horizontal direction orthogonal to the sheet of FIG. 1 and the like. The rotational operation of the stacking wheel 28 is performed by a stacking-wheel drive unit 29 (not shown in FIGS. 1 and 2) that will be described later. In this stacking wheel 28, a plurality of vanes 28*a* are provided to extend outward, from an outer circumferential face of the wheel 28, in a direction reverse to the rotation direction of the wheel 28 (i.e., the anticlockwise direction in FIG. 1 and the like). More specifically, such vanes 28*a* are provided to the outer circumferential face of the stacking wheel 28, at an equal interval, as shown in FIG. 1 and the like.

The stacking wheel 28 is configured to be constantly rotated in the clockwise direction in FIG. 1 and the like, by the stacking-wheel drive unit 29, during the operation of the paper-sheet counting machine 10, thereby to receive the paper sheets P, respectively fed from the transport unit 22, one by one. Then, the stacking wheel 28 receives each paper sheet P fed from the transport unit 22, between the two vanes 28*a* thereof, and then feeds the paper sheet P received between the two vanes 28*a* into the stacking unit 26. In this way, the paper sheets P can be fed to the stacking unit 26, one by one, from the stacking wheel 28, as such the plurality of paper sheets P can be stacked in the stacking unit 26.

In the paper-sheet counting machine 10 of this embodiment, a shutter 40 is provided to close the opening provided in the front face of the stacking unit 26. Thus, the opening in the front face of the stacking unit 26 can be selectively closed by the shutter 40. By a shutter drive unit 50 (not shown in FIGS. 1 and 2) that will be described later and is composed of, for example, a motor, the shutter 40 is moved, between the closing position, as depicted in FIG. 1, in which the opening in the front face of the stacking unit 26 is closed, and the opening position, as depicted in FIG. 2, in which the shutter 40 is retreated from the opening in the front face of the stacking unit 26 to open the opening. Namely, when the shutter 40 is located in the closing position as depicted in FIG. 1, the opening in the front face of the stacking unit 26 is closed, thus preventing the operator from accessing the paper sheets P respectively stacked in the stacking unit 26. Meanwhile, when the shutter 40 is located in the opening position as depicted in FIG. 2, this shutter 40 is retreated from the opening in the front face of the stacking unit 26, and thus the opening is opened, thereby allowing the operator to access the paper sheets P respectively stacked in the stacking unit 26.

Now, the reason why the shutter 40 is provided will be described below. In the paper-sheet counting machine 10 including the stacking wheel 28 provided to the stacking unit 26, each paper sheet P is stacked in the stacking unit 26, while falling down forward from the back (or rightward from the left as shown in FIG. 1 and the like). Therefore, there is a risk that the dust accumulated in the stacking unit 26 and the like and/or dust attached to each paper sheet P may be blown out toward the operator, via the opening in the front face of the stacking unit 26. However, when the shutter 40 is moved to the closing position, as depicted in FIG. 1, to close the opening in the front face of the stacking unit 26, this shutter 40 can serve to suppress the blowing out of the dust toward the operator with rotation of the stacking wheel 28. Further, when the shutter 40 is located in the closing position to close the opening in the front face of the stacking unit 26, the unwanted leakage of the sound generated in the paper-sheet counting machine 10, to the outside, can be prevented during the operation of the machine 10.

The shutter 40 may be composed of a transparent material, such as a plastic material or the like. In this case, even in the case the shutter 40 is located in the closing position in which the opening in the front face of the stacking unit 26 is closed as depicted in FIG. 1, the operator can confirm, with eyes, the stacked condition of the paper sheets P in the stacking unit 26, via the shutter 40 formed of a proper transparent material.

Next, the operation of the shutter 40 driven by the shutter drive unit 50 will be described in more detail, with reference to FIGS. 3 and 4. FIGS. 3 and 4 are respectively provided for illustrating the details of the construction of the shutter 40, shutter support unit 42 for supporting the shutter 40, shutter drive unit 50 and the like, respectively provided in the paper-sheet counting machine 10 shown in FIG. 1 and the like. More specifically, FIG. 3 is provided for illustrating one operational state corresponding to FIG. 1, in which the shutter 40 closes the opening provided in the front face of the stacking unit 26. Meanwhile, FIG. 4 is provide for illustrating another operational state corresponding to FIG. 2, in which the shutter 40 is retreated from the opening provided in the front face of the stacking unit 26 to open the opening.

As shown in FIG. 3 and the like, the shutter 40 is supported by the shutter support unit 42, and a substantially rectangular plate member 44 is attached to the shutter support unit 42. A shaft 44*a* is provided to a central part of the plate member 44, such that the plate member 44 is reciprocated about this shaft 44*a*. As such, the shutter 40 supported by the shutter support unit 42 is also reciprocated about the shaft 44*a*. Further, a circular linking member 44*b* is attached to one end of the plate member 44 on the opposite side of the shutter 40, such that this linking member 44*b* can be optionally rotated relative to the plate member 44.

Further, an elastic member, more specifically, one end 46*b* of a spring 46, is attached to the end of the plate member 44 opposite to the end thereof to which the linking member 44*b* is provided. In this case, the other end 46*a* of the spring 46 opposite to the one end 46*b* thereof attached to the plate member 44 is fixed to an inner face of the casing 12. Namely, the other end 46*a* of the spring 46 is fixed in position, while the position of the one end 46*b* of the spring 46 attached to the end of the plate member 44 is changed, with the reciprocation movement of the plate member 44 about the shaft 44*a*. With such configuration, due to contraction force of the spring 46, the shutter 40 is constantly biased from the opening position thereof as depicted in FIG. 4 toward the closing position thereof as depicted in FIG. 3.

Further, a cam 52 is provided to be in contact with the outer circumferential face of the circular linking member 44*b* rotatably provided relative to the plate member 44. This cam 52 has a rotation shaft 51 attached thereto and located in a point eccentric to the central part of the cam 52. This rotation shaft 51 is rotated in the anticlockwise direction in FIG. 3 and the like (as indicated by an arrow), by the shutter drive unit 50 composed of, for example, the motor or the like. Thus, the cam 52 is also rotated in the anticlockwise direction in FIG. 3 and the like (as indicated by the arrow), about the rotation shaft 51. With this rotation of the cam 52 about the rotation shaft 51, the linking member 44*b* that is in contact with an edge portion of the cam 52 is pressed and pushed upward in FIG. 3 (as indicated by another arrow), from the state shown in FIG. 3. Thus, the plate member 44 is rotated in the clockwise direction about the shaft 44*a*. As such, the shutter support unit 42 attached to the plate member 44 is also rotated in the clockwise direction about the shaft 44*a* from the state shown in FIG. 3, thus allowing the shutter support unit 42 to be moved to the position shown in FIG. 4 from the position shown in FIG. 3. In this way, the shutter 40 is moved to the opening position as depicted in FIG. 2, from the closing position as depicted in FIG. 1. During this operation, the spring 46 is expanded from the state shown in FIG. 3 to the state shown in FIG. 4.

However, when the cam 52 is further rotated about the rotation shaft 51, in the anticlockwise direction in FIG. 4 (as indicated by an arrow) from the state as shown in FIG. 4, the circular linking member 44*b* provided to the plate member 44 is no longer pressed upward in FIG. 4 by the cam 52. As such, due to the contraction force of the spring 46, the plate member 44 is rotated in the anticlockwise direction in FIG. 4, about the shaft 44*a*, from the state shown in FIG. 4. Thus, the shutter support unit 42 attached to the plate member 44 is also rotated in the anticlockwise direction, about the shaft 44*a*, from the state shown in FIG. 4, and hence returned to the position shown in FIG. 3 from the position shown in FIG. 4. In this way, the shutter 40 is returned to the closing position as shown in FIG. 1, from the opening position as shown in FIG. 2. During this operation, the spring 46 is contracted into the state shown in FIG. 3, from the state shown in FIG. 4.

In this way, the shutter 40 is reciprocated about the shaft 44*a* by the shutter drive unit 50, between the closing position (see FIGS. 1 and 3), in which the opening in the front face of the stacking unit 26 is closed, and the opening position (see FIGS. 2 and 4), in which the shutter 40 is retreated from the opening to open this opening. In the opening position, as shown in FIG. 2 and the like, the shutter 40 is located below the stacking wheel 28. Thus, when the shutter 40 is located in the opening position, the dust generated from the stacking wheel 28 and the like can be received by this shutter 40, thereby preventing such dust being accumulated on an inner bottom face of the casing 12.

For instance, the time required for the shutter 40 to be moved from the closing position shown in FIG. 1 to the opening position shown in FIG. 2 and the time required for the shutter 40 to be moved from the opening position shown in FIG. 2 to the closing position shown in FIG. 1 are set at 0.5 seconds, respectively.

Further, since the shutter 40 is biased, toward the closing position as depicted in FIG. 3 from the opening position as depicted in FIG. 4, by the contraction force of the spring 46, this shutter 46 can be moved downward, by hand, from the closing position shown in FIG. 3, against the contraction force of the spring 40. Therefore, the shutter 40 can be retreated, as needed, by hand, from the opening in the front face of the stacking unit 26, even in a period of time during which the shutter 40 is located in the closing position shown in FIG. 3 and the paper sheets P are counted by the recognition and counting unit 24. In this way, the paper sheets P can be taken out from the stacking unit 26.

Further, as described above, the spring 46 is provided to the shutter 40, and the cam 52 is provided to the shutter drive unit 50, while being engaged with the linking member 44*b* of the plate member 44. In addition, the shutter 40 can be biased toward the closing position (as shown in FIG. 3) in which the opening in the front face of the stacking unit 26 is closed, by the contraction force of the spring 46, as well as can be retreated from the opening in the front face of the stacking unit 26 toward the opening position (as shown in FIG. 4) to open the opening, by the cam 52 provided to the shutter drive unit 50. Therefore, this configuration can successfully prevent the finger or the like of the operator from being accidentally nipped and injured by the shutter 40, during the period of time in which the shutter 40 is moved from the opening position shown in FIG. 2 to the closing position shown in FIG. 1. This is because, the force used for pressing and moving the shutter 40 toward the closing position is not the driving force exerted from the shutter drive unit 50, but the contraction force of the spring 46.

As shown in FIGS. 3 and 4, a shutter-closing detection sensor 54*a* and a shutter-opening detection sensor 54*b* are respectively fixed in position in the vicinity of the cam 52. Each of the shutter-closing detection sensor 54*a* and shutter-opening detection sensor 54*b* is composed of an optical sensor. Further, a detection target member 53 to be detected by each of the shutter-opening detection sensor 54*a* and shutter-opening detection sensor 54*b* is provided to one side face of the cam 52. In this case, as shown in FIG. 3, when the shutter-closing detection sensor 54*a* detects the detection target member 53, the shutter 40 is detected to be in the closing position. Meanwhile, when the cam 52 is rotated in the anticlockwise direction about the rotation shaft 51, from the state shown in FIG. 3 to the state shown in FIG. 4, the shutter-opening detection sensor 54*b* detects the detection target member 53. As a result, the shutter 40 is detected to be in the opening position.

In addition, as shown in FIG. 1 and the like, various sensors are provided to the paper-sheet counting machine 10. Specifically, to the placing unit 14, a placing-unit-residue detection sensor (or first paper-sheet detection unit) 60 is provided for detecting whether or not there are some paper sheets P remaining on the placing unit 14. Further, to the reject unit 30, a reject-unit paper-sheet detection sensor (or second paper-sheet detection unit) 62 is provided for detecting whether or not there are some reject paper sheets P' remaining in the reject unit 30. Additionally, to the transport unit 22 located on the upstream side relative to the recognition and counting unit 24, a paper-sheet tracking detection sensor (or third paper-sheet detection unit) 64 is provided for detecting each paper sheet P when the paper sheet P transported by the transport unit 22 passes through this paper-sheet tracking detection sensor 64. In FIGS. 1 and 2, while the paper-sheet tracking detection sensor 64 is located on the upstream side relative to the recognition and counting unit 24 in the transport unit 22, this paper-sheet tracking detection sensor 64 may be located on the downstream side relative to the recognition and counting unit 24.

Now, the position in which the paper-sheet tracking detection sensor 64 is located will be described more specifically. Namely, this paper-sheet tracking detection sensor 64 is provided to the transport unit 22, in such a position that interval of time between the time one paper sheet P is detected by the paper-sheet tracking detection sensor 64 and the time this paper sheet P is fed to the stacking unit 26, is substantially matched with the time required for the shutter 40 to be moved from the closing position (see FIG. 1) in which the opening in the front face of the stacking unit 26 is closed to the opening position (see FIG. 2) in which the opening is opened (e.g., 0.5 seconds). With such provision of the paper-sheet tracking detection sensor 64 in the position as described above in the transport unit 22, if the shutter 40 starts to move from its closing position shown in FIG. 1 when one paper sheet P is detected by the paper-sheet tracking detection sensor 64, this paper sheet P reaches the stacking unit 26 at the same time the shutter 40 reaches the opening position shown in FIG. 2. Thus, the operator can take out each paper sheet P from the stacking unit 26, immediately after the paper sheet P reaches the stacking unit 26.

Additionally, a diversion timing sensor 66 is provided on the upstream side relative to the diverter 32 in the transport unit 22. The diverter 32 is optionally moved to either one of a first position for feeding each paper sheet P to the stacking unit 26 and a second position for feeding the paper sheet P to the reject unit 30, at each timing on which the paper sheet P is detected by the diversion timing sensor 66 (e.g., in FIGS. 1 and 2, the diverter 32 is shown to be located in the position for feeding the paper sheet P to the stacking unit 26). With this configuration, each paper sheet P that has been transported by the transport unit 22 and detected by the diversion timing sensor 66 is selectively fed, by the diverter 32, to either one of the two transport paths.

Further, a stacking-unit paper-sheet detection sensor 68 is provided on a downstream-side end of the transport unit 22 extending toward the stacking unit 26. This stacking-unit paper-sheet detection sensor 68 serves to detect each paper sheet P when the paper sheet P is fed to the stacking wheel 28 from the transport unit 22. With the provision of this stacking-unit paper-sheet detection sensor 68, the number of the paper sheets P respectively fed to the stacking unit 26 can be counted.

As shown in FIG. 5 and the like, the paper-sheet counting machine 10 includes a control unit 70. This control unit 70 serves to control each component of the paper-sheet counting machine 10. More specifically, this control unit 70 is connected with each of the feeding unit 16, transport unit 22, recognition and counting unit 24, stacking-wheel drive unit 29 for driving the stacking wheel 28, diverter 32 and shutter drive unit 50 for driving the shutter 40. In this case, the recognition and counting result on each paper sheet P recognized by the recognition and counting unit 24 is sent to the control unit 70, while the control unit 70 sends a command signal to each of the feeding unit 16, transport unit 22, stacking-wheel drive unit 29, diverter 32, shutter drive unit 50 and the like, in order to control such components. Further, the control unit 70 is connected with each of the placing-unit-residue detection sensor 60, reject-unit paper-sheet detection sensor 62, paper-sheet tracking detection sensor 64, diversion timing sensor 66 and stacking-unit paper-sheet detection sensor 68, in order to receive each detection result from such sensors.

In addition, the control unit 70 is connected with the shutter-closing detection sensor 54*a* and shutter-opening detection sensor 54*b*. Thus, the control unit 70 receives information that the shutter 40 is located in the closing position shown in FIG. 3 or information that the shutter 40 is located in the opening position shown in FIG. 4, from the shutter-closing detection sensor 54*a* or shutter-opening detection sensor 54*b*. Furthermore, the control unit 70 is connected with a display unit 72 and an operation unit 74. The display unit 72 and operation unit 74 are respectively provided to a front face of the casing 12. In this case, the condition under which the paper sheets P are handled by the paper-sheet counting machine 10, more specifically the information on the number or the like of the paper sheets P counted by the recognition and counting unit 24, is displayed on the display unit 72. Further, the operator can input various commands to the control unit 70 via the operation unit 74.

Next, referring to the flow charts of FIGS. 6 through 8, the operation of the paper-sheet counting machine 10 constructed as described above will be discussed. It is noted that the operation of the paper-sheet counting machine 10 is performed by controlling each component of the paper-sheet counting machine 10, under control of the control unit 70.

First of all, the operator places the paper sheets P to be counted, on the placing unit 14, in the stacked condition.

In this case, two operational modes, i.e., a with-shutter-operation mode and a without-shutter-operation mode, are provided to the control unit 70. The with-shutter-operation mode means a mode in which the control unit 70 controls the shutter drive unit 50, in order to open and close the opening in the front face of the stacking unit 26 by using the shutter 40. Meanwhile, the without-shutter-operation mode means a mode in which the control unit 70 does not control the shutter drive unit 50 and thus the opening and closing operation for the opening in the front face of the stacking unit 26 is not performed by the shutter 40. When the paper-sheet counting machine 10 is operated, the operator selects either one of the with-shutter-operation mode and without-shutter-operation mode, via the operation unit 74.

In the case the without-shutter-operation mode is selected by the operator, via the operation unit 74, the paper sheets P placed on the placing unit 14 are counted and the so-counted paper sheets P are fed to the stacking unit 26, in a state in which the shutter 40 is kept located in the opening position shown in FIG. 2, or in a state in which the opening in the front face of the stacking unit 26 is kept opened.

Meanwhile, in the case the with-shutter-operation mode is selected by the operator, via the operation unit 74, the operation shown in the flow charts of FIGS. 6 through 8 is performed. Namely, in an initial state of this operation, the shutter 40 is retreated from the opening in the front face of the stacking unit 26 (i.e., the shutter 40 is located in the opening position shown in FIG. 2), and thus the opening in the front face of the stacking unit 26 is opened (STEP 1 of FIG. 6).

In this case, the control unit 70 serves to selectively perform a batch process mode, in which the counting unit 24 counts paper sheets P by the batch number, the batch number being instructed to the control unit 70 via the operation unit 74. Then, as shown in STEP 2 of FIG. 6, whether or not the batch process mode is performed is selected by the operator via the operation unit 74. If the batch process mode is selected to be performed by the operator, the operation, as is shown in the flow charts of FIGS. 7 and 8 described later, is performed. The operation of the paper-sheet counting machine 10 associated with this batch process mode will be described later. Meanwhile, if the batch process mode is not selected to be performed, the counting process for the paper sheets P, as will be described below, is performed in accordance with the flow chart of FIG. 6.

Namely, before the counting process for the paper sheets P by the recognition and counting unit 24 is started, the control unit 70 controls the shutter drive unit 50 to drive the shutter 40 to close the opening in the front face of the stacking unit 26 (STEP 3 of FIG. 6). More specifically, the shutter drive unit 50 rotates the rotation shaft 51 in the anticlockwise direction in FIG. 4 (i.e., in the direction indicated by the arrow), from the state shown in FIG. 4. As a result, the circular linking member 44*b* provided to the plate member 44 is no longer pressed upward in FIG. 4 by the cam 52. Thus, the plate member 44 is rotated, by the contraction force of the spring 46, in the anticlockwise direction in FIG. 4, about the shaft 44*a*, from the state shown in FIG. 4. Therefore, the shutter support unit 42 attached to the plate member 44 is also rotated in the anticlockwise direction in FIG. 4, about the shaft 44*a*, from the state shown in FIG. 4. Eventually, the shutter support unit 42 is moved from the position shown in FIG. 4 to the position shown in FIG. 3. In this way, the shutter 40 is moved from the opening position as shown in FIG. 2 to the closing position as shown in FIG. 1, thus closing the opening in the front face of the stacking unit 26.

The timing on which the opening in the front face of the stacking unit 26 is closed by the shutter 40 is set, as the timing before the counting process for the paper sheets P by the recognition and counting unit 24 is started, i.e., the timing before the counting process for the paper sheets P is started or timing substantially the same as the start of the counting process for the paper sheets P. If the opening in the front face of the stacking unit 26 is closed by the shutter 40 at substantially the same timing as the start of the counting process for the paper sheets P, the time required for the entire process for the paper sheets P in the paper-sheet counting machine 10 can be reduced.

The control unit 70 may control the shutter drive unit 50 to drive the shutter 40 to start closing the opening in the front face of the stacking unit 26, at the same time as the start of the counting process for the paper sheets P by the recognition and counting unit 24, thereby to close the opening in the front face of the stacking unit 26, while counting the paper sheets P. In this case, the opening in the front face of the stacking unit 26 is closed, in a period of time during which the paper sheets P are counted. Therefore, the time required for the entire process for the paper sheets P in the paper-sheet counting machine 10 can be reduced, as compared with the case in which the paper sheets P are counted after the opening in the front face of the stacking unit 26 is closed.

Thereafter, the paper sheets P, respectively placed in the stacked condition on the placing unit 14, are fed to the transport unit 22 in the casing 12, one by one, by the feeding unit 16, successively, from the paper sheet P located at the lowermost layer, and then transported by the transport unit 22. At this time, the recognition and counting process for the paper sheets P is performed by the recognition and counting unit 24. In this case, each paper sheet P recognized, as the normal paper sheet, by the recognition and counting unit 24 is fed to the stacking unit 26 via the diverter 32. More specifically, the paper sheets P are fed, one by one, from the transport unit 22 to the stacking wheel 28. Then, the stacking wheel 28 receives each paper sheet P fed from the transport unit 22, between the two vanes 28*a* thereof. Thereafter, each paper sheet P received between the two vanes 28*a* is fed into the stacking unit 26. In this way, the paper sheets P can be arranged in the stacking unit 26, by the stacking wheel 28. At this time, since the opening in the front face of the stacking unit 26 is closed by the shutter 40, the operator cannot take out the paper sheets P stacked in the stacking unit 26.

Meanwhile, each paper sheet that is not recognized as the normal paper sheet by the recognition and counting unit 24 and each paper sheet that cannot be recognized by the recognition and counting unit 24 are respectively fed, as the reject paper sheets P', to the reject unit 30, by the diverter 32. Since the opening is provided in the front face of the reject unit 30, the operator can take out the reject paper sheets P' stacked in the reject unit 30, via this opening.

When a maximum number of the reject paper sheets P' that can be stored in the reject unit 30 is set in advance, and when the number of the reject paper sheets P' fed to the reject unit 30 reaches this preset maximum number or when the reject unit 30 is full up with the reject paper sheets P', during the counting process for the paper sheets P in the paper-sheet counting machine 10 (STEP 4 of FIG. 6), this condition of the reject unit 30 is displayed on the display unit 72, and the counting process for the paper sheets P in the paper-sheet counting machine 10 is once stopped. Thereafter, the operator takes out the reject paper sheets P' from the reject unit 30 (STEP 5 of FIG. 6), sets again such reject paper sheets P' on the placing unit 14, and starts again the counting process for the paper sheet P, via the operation unit 74 (STEP 6 of FIG. 6). In this way, the counting process for the paper sheets P is started again in the paper-sheet counting machine 10. In place of the operator starting again the counting process for the paper sheets P, via the operation unit 74, the paper-sheet counting machine 10 may be configured to restart the counting process for the paper sheets P, automatically, therein, once the operator places the reject paper sheets P', respectively taken out form the reject unit 30, on the placing unit 14.

Further, when a maximum number of the paper sheets P that can be stored in the stacking unit 26 is set in advance, and when the number of the paper sheets P fed to the stacking unit 26 reaches this preset maximum number or when the stacking unit 26 is full up with the paper sheets P, during the counting process for the paper sheets P in the paper-sheet counting machine 10 (STEP 7 of FIG. 6), this condition of the stacking unit 26 is displayed on the display unit 72, and the counting process for the paper sheets P in the paper-sheet counting machine 10 is once stopped. Then, the control unit 70 controls the shutter drive unit 50 to move the shutter 40 to the opening position shown in FIG. 2 from the closing position shown in FIG. 1. As a result, the opening in the front face of the stacking unit 26 is opened (STEP 8 of FIG. 6). Thereafter, the operator takes out the paper sheets P stacked in the stacking unit 26 via the opening in the front face of the stacking unit 26 (STEP 9 of FIG. 6), and then starts again the counting process for the paper sheet P, via the operation unit 74 (STEP 10 of FIG. 6). In this way, the counting process for the paper sheets P in the paper-sheet counting machine 10 is started again. Also in this case, in place of the operator starting again the counting process for the paper sheets P, via the operation unit 74, the paper-sheet counting machine 10 may be configured to restart the counting process for the paper sheets P, automatically, therein, once the operator takes out the paper sheets P form the stacking unit 26. In this case, before the counting process for the paper sheets P is started again by the recognition and counting unit 24, the control unit 70 controls the shutter drive unit 50 to drive the shutter 40 to close the opening in the front face of the stacking unit 26 (STEP 3 of FIG. 6).

In this manner, the counting process for the paper sheets P in the paper-sheet counting machine 10 is continued, until no paper sheet P remains on the placing unit 14. During this counting process, the placing-unit-residue detection sensor 60 detects whether or not there are some paper sheets P remaining on the placing unit 14 (STEP 11 of FIG. 6). When the placing-unit-residue detection sensor 60 detects that there is no paper sheet P remaining on the placing unit 14, this detection result is displayed on the display unit 72. Thereafter, the reject-unit paper-sheet detection sensor 62 detects whether or not there are some reject paper sheets P' remaining in the reject unit 30 (STEP 12 of FIG. 6). When the reject-unit paper-sheet detection sensor 62 detects that there are some reject paper sheets P' remaining in the reject unit 30, this detection result is displayed on the display unit 72. Thereafter, the operator takes out the reject paper sheets P' from the reject unit 30 (STEP 15 of FIG. 6), sets again such paper sheets P' on the placing unit 14, and then starts again the counting process for the paper sheets P, via the operation unit 74 (STEP 16 of FIG. 6). In this way, the counting process for the paper sheets P in the paper-sheet counting machine 10 is started again. In place of the operator starting again the counting process for the paper sheets P, via the operation unit 74, the paper-sheet counting machine 10 may be configured to restart the counting process for the paper sheets P, automatically, therein, once the operator places the reject paper sheets P', respectively taken out form the reject unit 30, on the placing unit 14.

Meanwhile, when the placing-unit-residue detection sensor 60 detects that there is no paper sheet P remaining on the placing unit 14, and when the reject-unit paper-sheet detection sensor 62 detects that there is no reject paper sheet P' remaining in the reject unit 30, the counting process for the paper sheets P in the paper-sheet counting machine 10 is ended (STEP 13 of FIG. 6). Thereafter, the control unit 70 controls the shutter drive unit 50 to move the shutter 40 to the opening position shown in FIG. 2 from the closing position shown in FIG. 1. Thus, the opening in the front face of the stacking unit 26 is opened (STEP 14 of FIG. 6). Then, the operator takes out the paper sheets P stacked in the stacking unit 26, via the opening in the front face of the stacking unit 26. In this way, the operation of the paper-sheet counting machine 10, in the case of not performing the batch process mode, is completed.

According to the operation of the paper-sheet counting machine 10 as shown in the flow chart of FIG. 6, as shown in the operation in the STEP 3 of FIG. 6, the control unit 70 controls the shutter drive unit 50 to drive the shutter 40 to close the opening provided in the front face of the stacking unit 26, before the counting process for the paper sheets P is started by the recognition and counting unit 24. Therefore, the opening in the front face of the stacking unit 26 is closed by the shutter 40, during the period of time in which the counting process for the paper sheets P is performed by the recognition and counting unit 24, thereby preventing the dust accumulated in the casing of the paper-sheet counting machine 10 and/or dust attached to each paper sheet from being blown out toward the operator.

Further, as shown in the STEP 11 and STEP 13 of FIG. 6, when the paper sheets P placed on the placing unit 14 are all fed to the recognition and counting unit 24 and thus the placing-unit-residue detection sensor 60 detects that there is no paper sheet remaining on the placing unit 14, the control unit 70 controls the shutter drive unit 50 to retreat the shutter 40 from the opening provided in the front face of the stacking unit 26 to open the opening. Alternatively, skipping the operation in the STEP 12 of FIG. 6, or the control unit 70 may serve to open the opening in the front face of the stacking unit 26, once the placing-unit-residue detection sensor 60 detects that there is no paper sheet P remaining on the placing unit 14, irrespectively of whether or not there are some reject paper sheets P' remaining in the reject unit 30. In addition, interval of time between the time the placing-unit-residue detection sensor 60 detects that there is no paper sheet P remaining on the placing unit 14 and the time the control unit 70 controls the shutter drive unit 50 to retreat the shutter 40 from the opening in the front face of the stacking unit 26, may be optionally altered, by the operator, with appropriate settings via the operation unit 74. In this case, the operator can optionally select the order of priority, between the dustproof and/or soundproofing in the paper-sheet counting machine 10 and the reduction of the time required for handling the paper sheets P.

Further, as shown in the STEP 11 and STEP 12 of FIG. 6, when the reject-unit paper-sheet detection sensor 62 detects that there are some reject paper sheets P' remaining in the reject unit 30 even though the placing-unit-residue detection sensor 60 detects that there is no paper sheet P remaining on the placing unit 14, the control unit 70 serves to drive the shutter 40 to keep closing the opening provided in the front face of the stacking unit 26. This is because, when there are some reject paper sheets P' remaining in the reject unit 30 even though there is no paper sheet P remaining on the placing unit 14, it is necessary for the operator to take out such reject paper sheets P' from the reject unit 30, and set again the reject paper sheets P' on the placing unit 14, and then start again the counting process for the paper sheets P in the paper-sheet counting machine 10.

In the operation of the paper-sheet counting machine 10 as shown in the flow chart of FIG. 6, as shown in the operation in the STEP 7 of FIG. 6, when the paper-sheet tracking detection sensor 64 provided to the transport unit 22 detects a certain paper sheet, with which the stacking unit 26 will be full up upon receiving thereof, the control unit 70 may control the shutter drive unit 50 to retreat the shutter 40 from the opening in the front face of the stacking unit 26 to open the opening. Due to this operation, as compared with the case in which the shutter drive unit 50 starts to move the shutter 40 once the number of the paper sheets P fed to the stacking unit 26 reaches the preset maximum number of the paper sheets P that can be stored in the stacking unit 26 or once the stacking unit 26 is full up with the paper sheets P, the opening in the front face of the stacking unit 26 can be opened more rapidly, thereby to substantially reduce the time required for the entire process for the paper sheets P. It is noted that interval of time between the time the paper-sheet tracking detection sensor 64 detects the paper sheet P, with which the stacking unit 26 will be full up upon receiving thereof, and the time the control unit 70 controls the shutter drive unit 50 to retreat the shutter 40 from the opening in the front face of the stacking unit 26, may be optionally altered, by the operator, with proper settings via the operation unit 74. In this case, the operator can optionally select the order of priority, between the dustproof or soundproofing in the paper-sheet counting machine 10 and the reduction of the time required for handling the paper sheets P.

As described above, the paper-sheet tracking detection sensor 64 is provided in such a position that interval of time between the time one paper sheet P is detected by the paper-sheet tracking detection sensor 64 and the time this paper sheet P is fed to the stacking unit 26, is substantially matched with the time required for the shutter 40 to be moved from the closing position (see FIG. 1) in which the opening in the front face of the stacking unit 26 is closed to the opening position (see FIG. 2) in which the opening is opened. Therefore, when the paper-sheet tracking detection sensor 64 detects a certain paper sheet, with which the stacking unit 26 will be full up upon receiving this paper sheet P fed thereto, and then this paper sheet P actually reaches the stacking unit 26, the opening in the front face of the stacking unit 26 is just opened. Thus, the operator can take out a batch of the paper sheets P stacked in the stacking unit 26, just after the certain paper sheet P reaches the stacking unit 26.

Now, referring to the flow charts of FIGS. 7 and 8, the operation of the paper-sheet counting machine 10, in the case the batch process mode is selected by the operator, will be described.

First, the operator designates the batch number of the paper sheets, via the operation unit 74. Then, the control unit 70 compares the batch number inputted to the control 70 via the operation unit 74 with a preset number (e.g., ten) of the paper sheets (STEP 21 of FIG. 7). If the batch number inputted to the control unit 70 is equal to or greater than the preset number, the operation, shown in the flow chart of FIG. 8 described later, is performed. The operation of the paper-sheet counting machine 10 in the batch process mode will be described later. Meanwhile, in the case the batch number inputted to the control unit 70 via the operation unit 74 is smaller than the preset number, the control unit 70 serves to keep the shutter 40 retreated from the opening in the front face of the stacking unit 26, thereby to keep this opening opened. Thereafter, the counting process for the paper sheets P is performed, as will be described below.

Namely, the paper sheets P respectively placed, in the stacked condition, on the placing unit 14 are fed, one by one, to the transport unit 22 in the casing 12, by the feeding unit 16, successively, from the paper sheet P located at the lowermost layer, and then transported by the transport unit 22. During this operation, the paper sheets P are recognized and counted by the recognition and counting unit 24. In this case, each paper sheet P recognized as the normal paper sheet by the recognition and counting unit 24 is fed to the stacking unit 26 by the diverter 32. At this time, the paper sheets P are arranged in the stacking unit 26 by the stacking wheel 28.

Meanwhile, each paper sheet that is not recognized as the normal paper sheet by the recognition and counting unit 24 and each paper sheet that cannot be recognized by the recognition and counting unit 24 are respectively fed, as the reject paper sheets P', to the reject unit 30, by the diverter 32. Since the opening is provided in the front face of the reject unit 30, the operator can take out such reject paper sheets P' stacked in the reject unit 30, via this opening.

As described above, the maximum number of the reject paper sheets P' that can be stored in the reject unit 30 is set, in advance. In this case, when the number of the reject paper sheets P' fed to the reject unit 30 reaches the preset maximum number of the reject paper sheets P' that can be stored therein, or when the reject unit 30 is full up with the reject paper sheets P', during the counting process for the paper sheets P in the paper-sheet counting machine 10 (STEP 22 of FIG. 7), this condition of the reject unit 30 is displayed on the display unit 72, and the counting process for the paper sheets P in the paper-sheet counting machine 10 is once stopped. Thereafter, the operator takes out the reject paper sheets P' from the reject unit 30 (STEP 23 of FIG. 7), sets again such reject paper sheets P' on the placing unit 14, and starts again the counting process for the paper sheets P, via the operation unit 74 (STEP 24 of FIG. 7). In this way, the counting process for the paper sheets P is started again in the paper-sheet counting machine 10. In place of the operator starting again the counting process for the paper sheets P, via the operation unit 74, the paper-sheet counting machine 10 may be configured to restart the counting process for the paper sheets P, automatically, therein, once the operator places the reject paper sheets P', respectively taken out form the reject unit 30, on the placing unit 14.

Further, when the number of the paper sheets P respectively fed to the stacking unit 26 reaches the batch number inputted to the control unit 70, or when one batch process is completed, during the counting process for the paper sheets P in the paper-sheet counting machine 10 (STEP 25 of FIG. 7), this condition or state is displayed on the display unit 72, and the counting process for the paper sheets P in the paper-sheet counting machine 10 is ended (STEP 26 of FIG. 7). At this time, since the opening in the front face of the stacking unit 26 is kept opened, the operator can take out the paper sheets P stacked in the stacking unit 26, via the opening in the front face of the stacking unit 26. In this way, the operation of the paper-sheet counting machine 10 for one batch process is completed. Thereafter, when the operator starts again the counting process for the paper sheets P, via the operation unit 74, the next batch process is performed as shown in the flow chart of FIG. 7.

Meanwhile, when the number of the paper sheets P fed to the stacking unit 26 does not reach the batch number inputted to the control unit 70, and when the placing-unit-residue detection sensor 60 detects that there is no paper sheet P remaining on the placing unit 14 (STEP 27 of FIG. 7), this condition is displayed on the display unit 72. Then, the reject-unit paper-sheet detection sensor 62 detects whether or not there are some reject paper sheets P' remaining in the reject unit 30 (STEP 28 of FIG. 7). As a result, when the reject-unit paper-sheet detection sensor 62 detects the reject paper sheets P' remaining in the reject unit 30, this condition is further displayed on the display unit 72. Then, the operator takes out the reject paper sheets P' from the reject unit 30 (STEP 29 of FIG. 7), sets again such reject paper sheets P' on the placing unit 14, and then starts again the counting process for the paper sheets P, via the operation unit 74 (STEP 30 of FIG. 7). In this way, the counting process for the paper sheets P in the paper-sheet counting machine 10 is started again. In place of the operator starting again the counting process for the paper sheets P, via the operation unit 74, the paper-sheet counting machine 10 may be configured to restart the counting process for the paper sheets P, automatically, therein, once the operator places the reject paper sheets P', respectively taken out form the reject unit 30, on the placing unit 14.

Meanwhile, when the placing-unit-residue detection sensor 60 detects that there is no paper sheet P remaining on the placing unit 14, and when the reject-unit paper-sheet detection sensor 62 detects that there is no reject paper sheet P' remaining in the reject unit 30, if the operator inputs a command for terminating the counting process for the paper sheets P, to the control unit 70, via the operation unit 74

(STEP 31 of FIG. 7), the counting process for the paper sheets P in the paper-sheet counting machine 10 is ended (STEP 26 of FIG. 7). At this time, since the opening in the front face of the stacking unit 26 is kept opened, the operator can take out the paper sheets P stacked in the stacking unit 26, via the opening in the front face of the stacking unit 26.

Further, when the placing-unit-residue detection sensor 60 detects that there is no paper sheet P remaining on the placing unit 14, and when the reject-unit paper-sheet detection sensor 62 detects that there is no reject paper sheet P' remaining in the reject unit 30, if the operator places additional paper sheets P on the placing unit 14 (STEP 32 of FIG. 7), and then starts again the counting process for the paper sheets P, via the operation unit 74 (STEP 33 of FIG. 7), the counting process for the paper sheets P in the paper-sheet counting machine 10 is restarted. In place of the operator starting again the counting process for the paper sheets, via the operation unit 74, the paper-sheet counting machine 10 may be configured to restart the counting process for the paper sheets P, automatically, therein, once the operator places the additional paper sheets P on the placing unit 14.

In the operation of the paper-sheet counting machine 10 as shown in the flow chart of FIG. 7, as shown in the operation in the STEP 21 of FIG. 7, when the control unit 70 performs the counting process for the paper sheets P in the batch process mode, and when the batch number of the paper sheets P inputted to the control unit 70 is smaller than the preset number, the control unit 70 serves to retreat the shutter 40 from the opening provided in the front face of the stacking unit 26 to open this opening. Namely, in the case the batch number inputted to the control unit 70 is relatively small, if the opening and closing operation of the shutter 40 is performed for each batch process, the time required for the entire process for the paper sheets P becomes considerably long. Therefore, in this case, by keeping the opening opened in the front face of the stacking unit 26, the time required for the entire process for the paper sheets P can be reduced.

Next, referring to the flow chart of FIG. 8, the operation of the paper-sheet counting machine 10 will be further described, when the operator selects the batch process mode, and the batch number of the paper sheets inputted to the control unit 70 is equal to or greater than the preset number.

Before starting the counting process for the paper sheets P by the recognition and counting unit 24, the control unit 70 controls the shutter drive unit 50 to drive the shutter 40 to close the opening in the front face of the stacking unit 26 (STEP 41 of FIG. 8). Then, the counting process for the paper sheets P is performed, as will be described below.

Namely, the paper sheets P, respectively placed in the stacked condition on the placing unit 14, are fed to the transport unit 22 in the casing 12, one by one, by the feeding unit 16, successively, from the paper sheet P located at the lowermost layer, and then transported by the transport unit 22. At this time, the recognition and counting process for the paper sheets P is performed by the recognition and counting unit 24. In this case, each paper sheet P recognized, as the normal paper sheet, by the recognition and counting unit 24 is fed to the stacking unit 26 via the diverter 32. Then, the paper sheets P are arranged in the stacking unit 26, by the stacking wheel 28. At this time, since the opening in the front face of the stacking unit 26 is closed by the shutter 40, the operator cannot take out the paper sheets P stacked in the stacking unit 26.

Meanwhile, each paper sheet that is not recognized as the normal paper sheet by the recognition and counting unit 24, and each paper sheet that cannot be recognized by the recognition and counting unit 24 are respectively fed, as the reject paper sheets P', to the reject unit 30, via the diverter 32. In this case, since the opening is provided in the front face of the reject unit 30, the operator can take out the reject paper sheets P' stacked in the reject unit 30, via the opening.

As described above, when the preset maximum number of the reject paper sheets P' that can be stored in the reject unit 30 is set, and when the number of the reject paper sheets P' fed to the reject unit 30 reaches the preset maximum number of the reject paper sheets P' that can be stored therein or when the reject unit 30 is full up with such reject paper sheets P', during the counting process for the paper sheets P in the paper-sheet counting machine 10 (STEP 42 of FIG. 8), this condition of the reject unit 30 is displayed on the display unit 72, and the counting process for the paper sheets P in the paper-sheet counting machine 10 is once stopped. Thereafter, the operator takes out the reject paper sheets P' from the reject unit 30 (STEP 43 of FIG. 8), sets again such reject paper sheets P' on the placing unit 14, and starts again the counting process for the paper sheet P, via the operation unit 74 (STEP 44 of FIG. 8). In this way, the counting process for the paper sheets P is started again in the paper-sheet counting machine 10. In place of the operator starting again the counting process for the paper sheets P, via the operation unit 74, the paper-sheet counting machine 10 may be configured to restart the counting process for the paper sheets P, automatically, therein, once the operator places the reject paper sheets P, respectively taken out form the reject unit 30, on the placing unit 14.

Further, when the number of the paper sheets P respectively fed to the stacking unit 26 reaches the batch number inputted to the control unit 70, or when one batch process is completed, during the counting process for the paper sheets P in the paper-sheet counting machine 10 (STEP 45 of FIG. 8), this condition is displayed on the display unit 72, and the counting process for the paper sheets P in the paper-sheet counting machine 10 is ended (STEP 46 of FIG. 8). Thereafter, the control unit 70 controls the shutter drive unit 50 to move the shutter 40 to the opening position shown in FIG. 2 form the closing position shown in FIG. 1. Thus, the opening in the front face of the stacking unit 26 is opened (STEP 47 of FIG. 8), and then the operator takes out the paper sheets P stacked in the stacking unit 26, via the opening in the front face of the stacking unit 26. In this way, the operation of the paper-sheet counting machine 10 for one batch process is completed. Thereafter, when the operator starts again the counting process for the paper sheets P, via the operation unit 74, the next batch process is performed as shown in the flow chart of FIG. 8.

Meanwhile, when the number of the paper sheets P fed to the stacking unit 26 does not reach the batch number inputted to the control unit 70, and when the placing-unit-residue detection sensor 60 detects that there is no paper sheet P remaining on the placing unit 14 (STEP 48 of FIG. 8), this condition is displayed on the display unit 72. Thereafter, the reject-unit paper-sheet detection sensor 62 detects whether or not there are some reject paper sheets P' remaining in the reject unit 30 (STEP 49 of FIG. 8). When the reject-unit paper-sheet detection sensor 62 detects that there are some reject paper sheets P' remaining in the reject unit 30, this condition is displayed on the display unit 72. Thereafter, the operator takes out the reject paper sheets P' from the reject unit 30 (STEP 50 of FIG. 8), sets again such taken-out reject paper sheets P' on the placing unit 14, and then starts again the counting process for the paper sheets P, via the operation unit 74 (STEP 51 of FIG. 8). In this way, the counting process for the paper sheets P in the paper-sheet counting machine 10 is started again. In place of the operator starting again the counting process for the paper sheets P, via the operation unit 74, the paper-sheet counting machine 10 may be configured to restart the counting process for the paper sheets P, automatically, therein, once the operator places the reject paper sheets P', respectively taken out form the reject unit 30, on the placing unit 14.

Meanwhile, when the placing-unit-residue detection sensor 60 detects that there is no paper sheet P remaining on the placing unit 14, and when the reject-unit paper-sheet detection sensor 62 detects that there is no reject paper sheet P' remaining in the reject unit 30, if the operator inputs a command for ending the counting process for the paper sheets P, to the control unit 70, via the operation unit 74 (STEP 52 of FIG. 8), the counting process for the paper sheets P in the paper-sheet counting machine 10 is ended (STEP 46 of FIG. 8). Thereafter, the control unit 70 controls the shutter drive unit 50 to move the shutter 40 to the opening position shown in FIG. 2 from the closing position shown in FIG. 1. Thus, the opening in the front face of the stacking unit 26 is opened (STEP 47 of FIG. 8). Then, the operator takes out the paper sheets P stacked in the stacking unit 26, via the opening in the front face of the stacking unit 26.

Meanwhile, when the placing-unit-residue detection sensor 60 detects that there is no paper sheet P remaining on the placing unit 14, and when the reject-unit paper-sheet detection sensor 62 detects that there is no reject paper sheet P' remaining in the reject unit 30, if the operator places the additional paper sheets P on the placing unit 14 (STEP 53 of FIG. 8), and starts again the counting process for the paper sheets P, via the operation unit 74 (STEP 54 of FIG. 8), the counting process for the paper sheets P in the paper-sheet counting machine 10 is restarted. In place of the operator starting again the counting process for the paper sheets, via the operation unit 74, the paper-sheet counting machine 10 may be configured to restart the counting process for the paper sheets P, automatically, therein, once the operator places the additional paper sheets P on the placing unit 14.

According to the operation of the paper-sheet counting machine 10 as shown in the flow chart of FIG. 8, as shown in the operation in the STEP 45 and STEP 48 of FIG. 8, when the control unit 70 performs the counting process for the paper sheets P in the batch process mode, and when the placing-unit-residue detection sensor 60 detects that there is no paper sheet P remaining on the placing unit 14, if the number of the paper sheets P counted by the recognition and counting unit 24 does not reach the batch number, the control unit 70 controls the shutter drive unit 50 to drive the shutter 40 to keep closing the opening provided in the front face of the stacking unit 26. Namely, in this case, as shown in the STEP 53 and STEP 54 of FIG. 8, it is necessary for the operator to place the additional paper sheets P on the placing unit 14 and start again the counting process for the paper sheets P, via the operation unit 74. Therefore, even in the case the operation of the paper-sheet counting machine 10 is stopped, while the actual number of the paper sheets P fed to the stacking unit 26 is slightly short of the batch number inputted to the control unit 70, this paper-sheet counting machine 10 can prevent the operator from misunderstanding that the batch process has been properly performed and thus the number of the paper sheets P stacked in the stacking unit 26, at this point of time, is correctly corresponding to the batch number. Accordingly, this paper-sheet counting machine 10 can securely prevent the operator from mistakenly taking out the paper sheets P from the stacking unit 26.

Alternatively, in the operation of the paper-sheet counting machine 10 as shown in the flow chart of FIG. 8, the control unit 70 may control the shutter drive unit 50 to retreat the shutter 40 from the opening in the front face of the stacking unit 26 to open this opening, at a point of time that the paper-sheet tracking detection sensor 64 provided to the transport unit 22 detects the last paper sheet P of the batch number. With this operation, as compared with the case of starting to move the shutter 40 once the counting process for one batch process is completely finished or once the stacking-unit paper-sheet detection sensor 68 detects that the number of paper sheets P respectively fed to the stacking unit 26 reaches the batch number, the opening in the front face of the stacking unit 26 can be opened more rapidly, thereby to reduce the time required for the entire process for the paper sheets P. It is noted that interval of time between the time the paper-sheet tracking detection sensor 64 detects the last paper sheet P of the batch number and the time the control unit 70 controls the shutter drive unit 50 to retreat the shutter 40 from the opening in the front face of the stacking unit 26, may be optionally altered, by the operator, with appropriate settings, via the operation unit 74. In this case, the operator can optionally select the order of priority, between the dustproof or soundproofing in the paper-sheet counting machine 10 and the reduction of the time required for handling the paper sheets P.

Further, as described above, the paper-sheet tracking detection sensor 64 is provided to the transport unit 22, in such a position that interval of time between the time one paper sheet P is detected by the paper-sheet tracking detection sensor 64 and the time this paper sheet P is fed to the stacking unit 26, is substantially matched with the time required for the shutter 40 to be moved from the closing position (see FIG. 1) in which the opening in the front face of the stacking unit 26 is closed to the opening position (see FIG. 2) in which the opening is opened. With this configuration, the opening in the front face of the stacking unit 26 can be just opened at the time the last paper sheet P of the batch number actually reaches the stacking unit 26 after this paper sheet P is detected by the paper-sheet tracking detection sensor 64. As such, the operator can take out one batch of the paper sheets P stacked in the stacking unit 26, just after the last paper sheet P of the batch number reaches the stacking unit 26.

As stated above, according to the paper-sheet counting machine 10 of this embodiment, the opening and closing operation for the opening provided in the front face of the stacking unit 26 can be optionally performed by the shutter 40 driven by the shutter drive unit 50 controlled by the control unit 70. Therefore, the opening provided in the front face of the stacking unit 26 can be selectively closed by the shutter 40. Thus, when this shutter 40 closes the opening, the blowing out of the dust accumulated in the casing 12 of the paper-sheet counting machine 10 and/or dust attached to each paper sheet, toward the operator, can be successfully prevented. Further, when the shutter 40 closes the opening in the front face of the stacking unit 26, the unwanted leakage of the sound generated in the interior of the paper-sheet counting machine 10 to the outside can be effectively prevented during the operation of the machine 10.

It is noted that the paper-sheet counting machine according to the present invention is not limited to such an aspect as described above. For instance, any suitable variations or modifications can be made to the mechanism for driving the aforementioned shutter of the paper-sheet counting machine shown in FIGS. 3 and 4.

Figure 9:
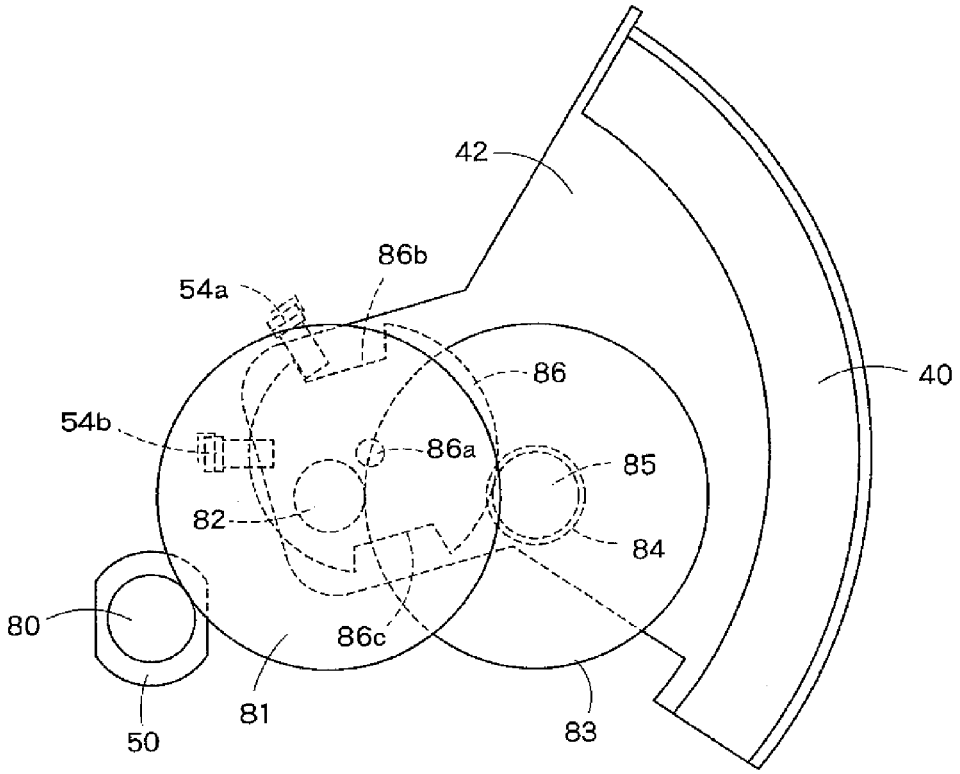
FIG. 9 is a side view for illustrating the construction of the shutter, shutter support unit for supporting the shutter, shutter drive unit, a plurality of gears, a torque limiter and the like, respectively provided in the paper-sheet counting machine related to one variation of the present invention.
Figure 10:
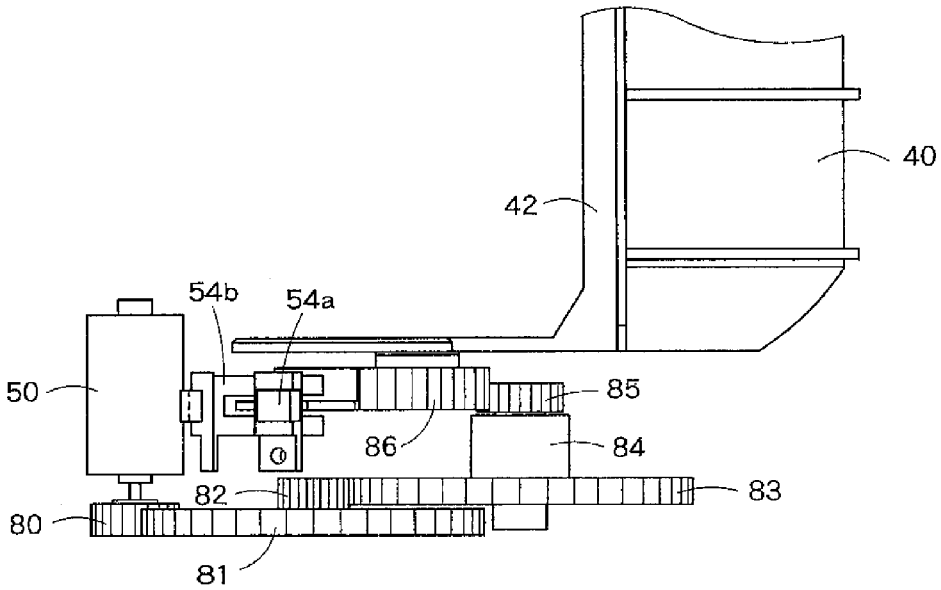
FIG. 10 is a top view for illustrating the shutter, shutter support unit for supporting the shutter, shutter drive unit, plurality of gears, torque limiter and the like, respectively shown in FIG. 9, when such units or parts are respectively seen from above.

FIGS. 9 and 10 respectively show one variation of the driving mechanism for driving the shutter in the paper-sheet counting machine of the present invention. Of these drawings, FIG. 9 shows one side view for illustrating the construction of the shutter, shutter support unit for supporting the shutter, shutter drive unit, a plurality of gears, torque limiter and the like, respectively provided in the paper-sheet counting machine related to one variation of the present invention. FIG. 10 shows one top view for illustrating the shutter, shutter support unit for supporting the shutter, shutter drive unit, a plurality of gears, torque limiter and the like, respectively shown in FIG. 9, when such units or parts are respectively seen from above. It is noted that FIG. 9 is provided for illustrating the construction of the shutter and the like when the shutter closes the opening provided in the front face of the stacking unit.

In the shutter drive mechanism of the paper-sheet counting machine in the variation of the present invention as shown in FIGS. 9 and 10, like parts or units are respectively designated by like reference numerals respectively shown in FIGS. 1 through 5.

As shown in FIGS. 9 and 10, a first gear 80 is attached to the shutter drive unit 50 composed of the motor, such that this first gear 80 is rotated by the shutter drive unit 50 in both of the clockwise and anticlockwise directions in FIG. 9. Further, a second gear 81 substantially larger, in size, than the first gear 80 is provided in the vicinity of the first gear 80. The first and second gears 80 and 81 are meshed with each other. Thus, the rotation force is transmitted from the first gear 80 to the second gear 81.

On one side face of the second gear 81 (more specifically, on an upper side face of the second gear 81 in FIG. 10), a third gear 82 substantially smaller, in size, than the second gear 81 is attached. The second and third gears 81 and 82 respectively have the same rotation shaft extending in one straight line. Thus, when the second gear 81 is rotated, the third gear 82 is rotated in synchronism with the second gear 81. Further, a fourth gear 83 substantially larger, in size, than the third gear 82 is provided in the vicinity of the third gear 82. Such third and fourth gears 82 and 83 are meshed with each other. Thus, the rotation force is transmitted from the third gear 82 to the fourth gear 83.

On one side face of the fourth gear 83, a fifth gear 85 substantially smaller, in size, than the fourth gear 83 is attached, via a torque limiter 84. Such fourth and fifth gears 83 and 85 have the same rotation shaft extending in one straight line. Thus, when the fourth gear 83 is rotated, the fifth gear 85 is rotated in synchronism with the forth gear 83. In this case, if the rotation force greater than a preset torque is applied to the torque limiter 84 provided between the fourth gear 83 and the fifth gear 85, the connection between the fourth gear 83 and the fifth gear 85 is released, and then the fifth gear 85 will be rotated freely relative to the fourth gear 83.

In addition, a sixth gear 86 substantially larger, in size, than the fifth gear 85 is provided in the vicinity of the fifth gear 85. Such fifth and sixth gears 85 and 86 are meshed with each other. Thus, the rotation force is transmitted from the fifth gear 85 to the sixth gear 86. Further, the sixth gear 86 is attached to the shutter support unit 42 for supporting the shutter 40. Therefore, the sixth gear 86 is rotated integrally with the shutter support unit 42 about a shaft 86*a*.

A first notched portion 86*b* and a second notched portion 86*c* are respectively provided to the sixth gear 86. Additionally, the shutter-closing detection sensor 54*a* and shutter-opening detection sensor 54*b* are respectively fixed in position, in the vicinity of the sixth gear 86. Each of such shutter-closing detection sensor 54*a* and shutter-opening detection sensor 54*b* is composed of the optical sensor. In this case, when the shutter 40 is located in the closing position, the position of the first notched portion 86*b* of the sixth gear 86 is substantially matched with the position of the shutter-closing detection sensor 54*a*. Therefore, the detection of the first notched portion 86*b* of the sixth gear 86 by the shutter-closing detection sensor 54*a* indicates the detection of the shutter 40 located in the closing position. Meanwhile, when the shutter 40 is located in the opening position, the position of the second notched portion 86*c* of the sixth gear 86 is substantially matched with the position of the shutter-opening detection sensor 54*b*. Therefore, the detection of the second notched portion 86*c* of the sixth gear 86 by the shutter-opening detection sensor 54*b* indicates the detection of the shutter 40 located in the opening position.

Now, the operation of the shutter drive mechanism of the paper-sheet counting machine related to the variation of the present invention, as shown in FIGS. 9 and 10, will be described.

In the case of driving the shutter 40 to move to the opening position from the closing position shown in FIG. 9, the shutter drive unit 50 composed of the motor serves to rotate the first gear 80 in the clockwise direction in FIG. 9. Thus, the driving force exerted from the shutter drive unit 50 is transmitted, from the first gear 80, through the second gear 81, third gear 82, fourth gear 83, torque limiter 84 and fifth gear 85, up to the sixth gear 86, as such the sixth gear 86 is rotated in the clockwise direction in FIG. 9 about the shaft 86*a*. Therefore, the shutter support unit 42 attached to the sixth gear 86 is also rotated in the clockwise direction in FIG. 9 about the shaft 86*a*. As a result, the shutter 40 is moved from the closing position as shown in FIG. 1 to the opening position as shown in FIG. 2.

Meanwhile, in the case of driving the shutter 40 to move to the closing position from the opening position, the shutter drive unit 50 composed of the motor serves to rotate the first gear 80 in the anticlockwise direction in FIG. 9. In this way, the driving force exerted from the shutter drive unit 50 is transmitted, from the first gear 80, through the second gear 81, third gear 82, fourth gear 83, torque limiter 84 and fifth gear 85, up to the sixth gear 86, as such the sixth gear 86 is rotated in the anticlockwise direction in FIG. 9 about the shaft 86*a*. Thus, the shutter support unit 42 attached to the sixth gear 86 is also rotated in the anticlockwise direction in FIG. 9 about the shaft 86*a*. As a result, the shutter 40 is moved from the opening position as shown in FIG. 2 to the closing position as shown in FIG. 1.

As described above, the torque limiter 84 is provide between the shutter support unit 42 for supporting the shutter 40 and the shutter drive unit 50. Therefore, in the case the operator moves the shutter 40 downward, by hand, from the closing position shown in FIG. 1, when the force applied from the operator to the torque limiter 84 is greater than the preset torque, the torque limiter 84 releases the connection between the fourth gear 83 and the fifth gear 85. As such, the fifth gear 85 can be rotated freely relative to the fourth gear 83. Namely, in this case, the torque limiter 84 serves to block the driving force of the shutter drive unit 50 to be transmitted to the shutter 40. Therefore, even in the period during which the counting process for the paper sheets P is performed by the recognition and counting unit 24, the operator can move the shutter 40 downward, by hand, from the closing position shown in FIG. 1, thereby to take out the paper sheets P from the stacking unit 26.

Further, even in the case the hand or the like of the operator is placed in the stacking unit 26 in a period during which the shutter 40 is moved from the opening position shown in FIG. 2 to the closing position shown in FIG. 1, if the force applied to the torque limiter 84 becomes greater than the preset torque once the shutter is in contact with such a hand or the like of the operator, the torque limiter 84 releases the connection between the fourth gear 83 and the fifth gear 85, thus allowing the fifth gear 85 to be rotated freely relative to the fourth gear 83. In this way, the torque limiter 84 serves to block the driving force of the shutter drive unit 50 to be transmitted to the shutter 40. Thus, the shutter 40 is stopped when this shutter 40 is in contact with the hand or the like of the operator, thereby successfully preventing such trouble that the finger or the like of the operator is seriously nipped and injured by the shutter 40.

The invention claimed is:

1. A paper-sheet counting machine comprising:

a counting unit configured to count paper sheets and to recognize the paper sheets;

a stacking unit configured to stack therein the paper sheets that have been counted by the counting unit, an opening being provided at the stacking unit;

a reject unit configured to receive the paper sheets respectively recognized as reject paper sheets by the counting unit and fed thereto from the counting unit;

a shutter configured to close the opening provided at the stacking unit;

a shutter drive unit configured to drive the shutter to open and close the opening provided at the stacking unit;

a control unit configured to control the shutter drive unit;

a placing unit configured to place thereon the paper sheets to be respectively counted by the counting unit, for allowing such paper sheets, respectively placed on the placing unit, to be fed, one by one, to the counting unit;

a first paper-sheet detection unit configured to detect whether or not the paper sheets are placed on the placing unit; and a second paper-sheet detection unit configured to detect whether or not the paper sheets are stacked in the reject unit;

wherein after the first paper-sheet detection unit detects that there is no paper sheet remaining on the placing unit, and all the paper sheets on the placing unit have been fed to and stacked in the stacking unit and the reject unit, where at least one paper sheet in the reject unit is detected by the second paper-sheet detection unit, the control unit does not open a closed shutter by controlling the shutter drive unit until satisfying a condition that the second paper-sheet detection unit detects that there is no paper sheet in the reject unit, and when the control unit detects the condition is satisfied, the control unit opens the closed shutter automatically without manual instruction for opening the closed shutter.

2. The paper-sheet counting machine according to claim 1, further comprising a transport unit configured to transport the paper sheets; and a recognition and counting unit to recognize and count the paper sheets transported by the transport unit;

wherein a third paper-sheet detection unit includes a sensor provided at the transport unit located at the upstream side relative to the recognition and counting unit.

3. The paper-sheet counting machine according to claim 1, further comprising a transport unit configured to transport the paper sheets; and a recognition and counting unit to recognize and count the paper sheets transported by the transport unit;

wherein a third paper-sheet detection unit is the recognition and counting unit.

4. The paper-sheet counting machine according to claim 1, further comprising a rotary guide unit provided to the stacking unit and configured to allow the paper sheets that have been counted by the counting unit to be stacked in the stacking unit.

5. The paper-sheet counting machine according to claim 4, wherein the shutter is capable of being reciprocated between a closed position for closing the opening and an open position for opening the opening, wherein at least a part of the shutter is located below the rotary guide unit when the shutter is located in the open position.

6. The paper-sheet counting machine according to claim 1, wherein the control unit serves to selectively perform a batch process mode, in which paper sheets are stacked in the stacking unit by a set batch number, and when the first paper-sheet detection unit detects that there is no paper sheet remaining on the placing unit and when the number of the paper sheets fed to the stacking unit does not reach the batch number, during the process for the paper sheets in the batch process mode performed by the control unit, the control unit serves to drive the shutter to close the opening provided at the stacking unit.

* * * * *